US012110764B2

(12) United States Patent
Ringgenberg

(10) Patent No.: US 12,110,764 B2
(45) Date of Patent: Oct. 8, 2024

(54) FLUIDIC DIODE OPERATED AUTOFILL VALVE

(71) Applicant: Halliburton Energy Services, Inc., Houston, TX (US)

(72) Inventor: Paul D. Ringgenberg, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/070,874

(22) Filed: Nov. 29, 2022

(65) Prior Publication Data

US 2024/0175337 A1 May 30, 2024

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/10; E21B 34/14; E21B 43/12; E21B 2200/06
See application file for complete search history.

(56) References Cited

U.S. PATENT DOCUMENTS

| | | | |
|---|---|---|---|
| 1,329,559 | A | 2/1920 | Tesla |
| 6,059,038 | A | 5/2000 | Vick, Jr. |
| 8,047,293 | B2 | 11/2011 | Xu et al. |
| 9,169,855 | B1 | 10/2015 | Dyson |
| 9,915,362 | B2 | 3/2018 | Hampton et al. |
| 10,214,991 | B2 | 2/2019 | Van Petegem et al. |
| 10,711,569 | B2 | 7/2020 | Rong et al. |
| 10,844,691 | B2 | 11/2020 | Van Petegem et al. |
| 10,907,445 | B2 | 2/2021 | Huggins et al. |
| 11,428,072 | B2 | 8/2022 | Rong et al. |
| 2011/0042092 | A1* | 2/2011 | Fripp ..... E21B 34/08 138/42 |
| 2017/0044868 | A1* | 2/2017 | van Petegem ..... E21B 43/12 |

FOREIGN PATENT DOCUMENTS

EP 2959098 A1 12/2015

OTHER PUBLICATIONS

"AutoFill™ pre-adjustable filling units & backflow preventer", Caleffi Hydronic Solutions, 2015, Caleffi North America, Inc.

* cited by examiner

*Primary Examiner* — Christopher J Sebesta
*Assistant Examiner* — Lamia Quaim
(74) *Attorney, Agent, or Firm* — Conley Rose, P.C.; Rodney B. Carroll

(57) ABSTRACT

A shifting tool including a flow sleeve having a fluidic diode to facilitate flow from an exterior port to an interior port along the flow sleeve and restrict flow in the opposite direction. In a first configuration of the shifting tool, a flow path extends from the exterior of a case, via the exterior port, along the flow sleeve, and, via the interior port, to a flow bore of an operating mandrel. Upon exposure to a pressure differential between a cavity in which the flow sleeve is positioned and the flow bore above a threshold pressure differential, a shear pin breaks, such that the shifting tool assumes the second configuration. In the second configuration, the operating mandrel has shifted longitudinally whereby a snap ring extends into a recess or groove in an outside surface of the operating mandrel, to hold the operating mandrel in the second configuration.

22 Claims, 11 Drawing Sheets

FLUIDIC DIODE OPERATED AUTOFILL VALVE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to wellbore operations. More specifically, the present disclosure relates to systems and methods for actuating a downhole tool (e.g., for operating an autofill tool for controlling fluid communication between the interior and exterior of a production or other tubular string). Still more specifically, the present disclosure relates to systems and methods for actuating a downhole tool via the use of a fluidic diode.

BACKGROUND

Hydrocarbon wells (for example, for the production of hydrocarbons such as oil and gas) typically have a well bore drilled into a subterranean formation (e.g., in the ground) containing the hydrocarbons. Such formations typically have one or more production zones that can be accessed to extract the formation fluids (for example, hydrocarbons) via the wellbore. In some embodiments, a production zone can be completed as an open-hole (e.g., an "uncased") completion. Alternatively, a production zone can be completed, for example, by placing a casing within a portion of the wellbore and perforating (or otherwise providing a route of fluid communication into) the casing, for example, in a position adjacent to a production zone. Often two or more production zones can be separated or isolated from each other using isolation devices (e.g., hydraulic, swellable, and/or mechanical packers) inserted into the wellbore.

In embodiments, during "run-in" of a production string (e.g., placement of a production string or other tubular string within a wellbore, it can be desirable to allow fluid and/or pressure to enter the production string (or other tubular string) from the exterior of the production string and to prevent fluid and/or pressure from exiting the production string. Thus, a need exists to selectively control fluid communication between the interior and exterior of the production or other tubular string.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
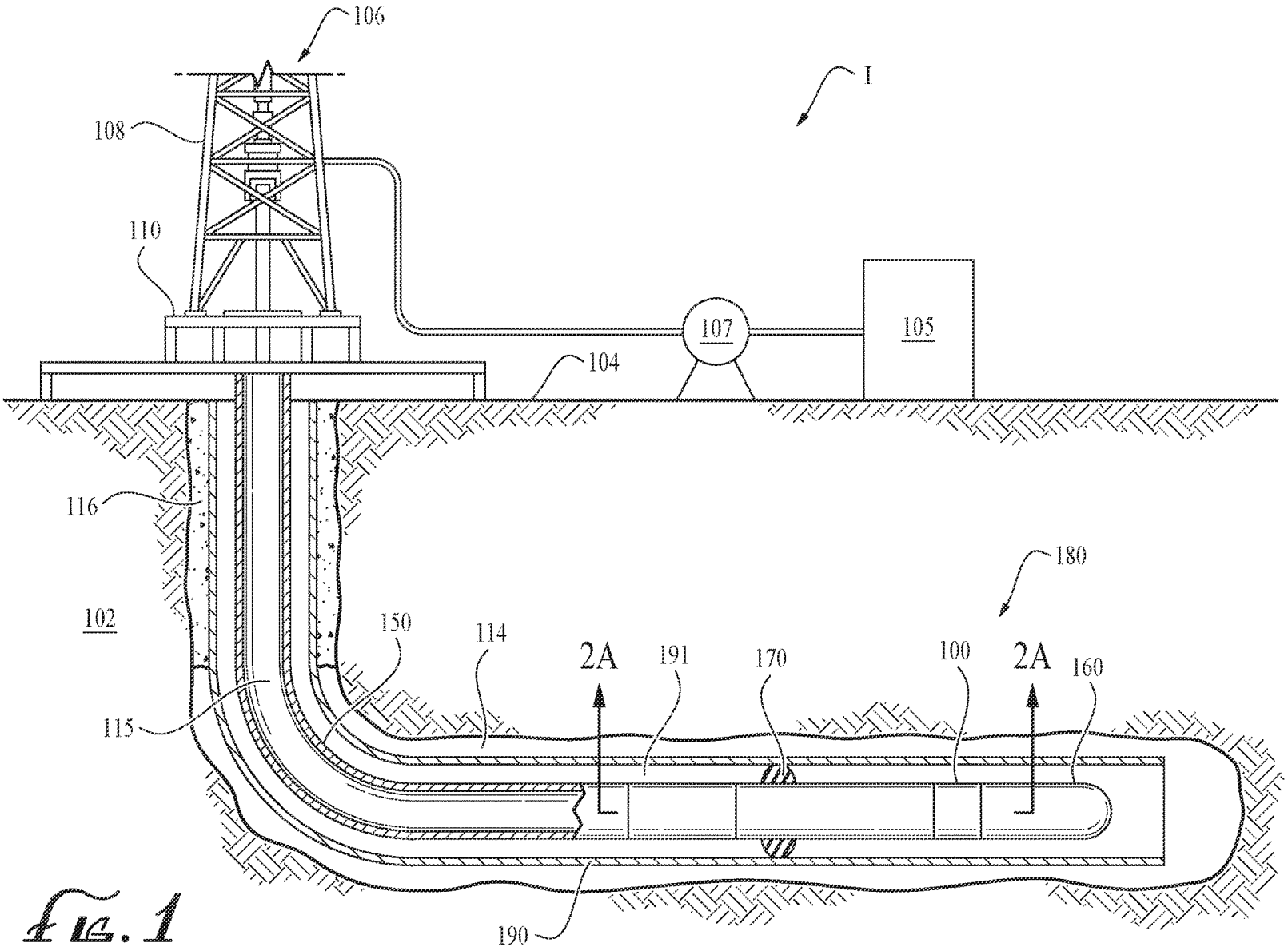
FIG. 1 is a partial cut-away view of an operating environment of an autofill assembly depicting a wellbore penetrating a subterranean formation and a production string having the autofill assembly incorporated therein and positioned within the wellbore, according to embodiments of this disclosure.

It should be understood at the outset that although an illustrative implementation of one or more embodiments are provided below, the disclosed systems and/or methods can be implemented using any number of techniques, whether currently known or in existence. The disclosure should in no way be limited to the illustrative implementations, drawings, and techniques below, including the exemplary designs and implementations illustrated and described herein, but can be modified within the scope of the appended claims along with their full scope of equivalents.

In the drawings and description that follow, like parts are typically marked throughout the specification and drawings with the same reference numerals, respectively. In addition, similar reference numerals may refer to similar components in different embodiments disclosed herein.

The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein can be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water Disclosed herein are embodiments of a shifting tool (e.g., an autofill tool) and methods of using the same. Particularly, disclosed herein are embodiments of a shifting tool which may be incorporated within a wellbore tubular, for example a production string and/or production tubular positioned within a wellbore penetrating a subterranean formation.

In embodiments, a string (e.g., a production string) comprising a shifting tool of this disclosure can be configured such that during "run-in" (e.g., into a well bore) fluid is allowed to be communicated from the exterior of the string (e.g., production string) to the flowbore of the string (e.g., production string). Where a production string has been placed within a wellbore and, for example, prior to the commencement of stimulation (e.g., fracturing and/or perforating) operations, it may be desirable to disallow fluid communication, in either direction, between the exterior of the production string and the flowbore of the production string. In embodiments, the shifting tool can be configured so as to disallow fluid communication between the exterior of the shifting tool and the interior thereof.

Although a shifting tool is disclosed with reference to use or incorporation with a production string, a shifting tool or similarly configured tool may be used or incorporated within other suitable tubulars such as a casing string, a work string, drill stem testing string, on top of a closed chamber testing string, liner, coiled tubing, a length of tubing, or the like.

Referring to FIG. 1, an embodiment of an operating environment I in which such a shifting tool may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 by any suitable drilling technique. In embodiments, the drilling or servicing rig 106 comprises a derrick 108 with a rig floor 110 through which a completion string 190 (e.g., a casing string) generally defining an axial flowbore 191 may be positioned within the wellbore 114. The drilling or servicing rig 106 may be conventional and may comprise a motor driven winch and other associated equipment for lowering a tubular, such as the completion string 190 into the wellbore 114, for example, so as to position the completion equipment at the desired depth.

In embodiments the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In embodiments, a portion of the completion string 190 may be secured into position against the formation 102 in a conventional manner using cement 116. In alternative embodiment, the wellbore 114 may be partially completed (e.g., cased) and cemented thereby resulting in a portion of the wellbore 114 being uncemented. In embodiments, a production string 150 comprising a shifting tool 100 may be delivered to a predetermined depth within the wellbore.

It is noted that although the shifting tool 100 is disclosed as being incorporated within a production string in one or more embodiments, the specification should not be construed as so-limiting. A tool such as the shifting tool 100 may similarly be incorporated within other suitable tubulars such as a casing string, a work string, liner, coiled tubing, a length of tubing, or the like.

Referring to FIG. 1, the production string 150 and/or the shifting tool 100 may further comprise (e.g., have incorporated therein) one or more packers 170, for example, for the purpose of securing the production string 150 and/or the shifting tool 100 within the wellbore 114, within the completion string 190, and/or isolating two or more production zones.

The packer 170 may generally comprise a device or apparatus which is selectively configurable to seal or isolate two or more depths in a wellbore from each other by providing a barrier concentrically about a tubular string (e.g., the production string 150) and an outer surface (e.g., a wellbore or casing wall). In embodiments, the packer 170 may comprise a hydraulic (or hydraulically set) packer. Alternatively, the packer may comprise any suitable configuration of mechanical packer or a swellable packer (for example, SwellPackers™, commercially available from Halliburton Energy Services).

A pump or pumping system 107 and fluid source 105 may be utilized to introduce fluid into shifting tool 100 via the production string 150, for example to increase the pressure in axial flow bore 115 (and flow bore 200 of shifting tool, as described further hereinbelow), thus providing the impetus for transitioning of the shifting tool 100 from a first configuration (optionally to an intermediate configuration, as described with reference to FIG. 4B hereinbelow, and) to a second configuration, as detailed hereinbelow. In embodiments, the shifting tool 100 can be located above the packer.

Additionally, in embodiments, a portion of the interior of the production string 150 may be blocked with a plug 160, for example, so as to allow a pressure to be applied thereto. For example, in the embodiment of FIG. 1, the plug 160 may be positioned down-hole from the shifting tool 100, thereby prohibiting and/or substantially restricting a fluid from moving via the axial flowbore of the production string 150, particularly, from moving out of the downhole, terminal end of the production string 150. Non-limiting examples of a plug suitably employed as plug 160 include a pump-through plug or a plug formed as an integral part of a production string (for example, The Mirage™ disappearing plug, commercially available from Halliburton Energy Services).

While the operating environment depicted in FIG. 1 refers to a stationary drilling or servicing rig 106 for lowering and setting the production string 150 within a land-based wellbore 114, one of ordinary skill in the art will readily appreciate that mobile workover rigs, wellbore completion units (e.g., coiled tubing units). It should be understood that a shifting tool may be employed within other operational environments, such as within an offshore wellbore operational environment.

Referring to FIG. 1, a wellbore completion system 180 is illustrated. In the embodiment of FIG. 1, the wellbore completion system 180 comprises a shifting tool 100 incorporated with the production string 150 and positioned within a wellbore 114. Additionally, in embodiments, the wellbore completion system 180 may further comprise the plug 160.

In such an embodiment, the plug 160 may be incorporated with the production string 150, for example, as an integral part of the production string 150 and may be positioned relatively down-hole from the shifting tool 100.

In one or more of the embodiments as will be disclosed herein, the shifting tool 100 may be configured to transition from a first configuration to a second configuration (and optionally also from the first configuration to an intermediate configuration prior to transitioning to the second configuration, as described with reference to FIG. 4B hereinbelow) while disposed the wellbore 114. Particularly, a first embodiment is disclosed with respect to FIGS. 2A-2C, a second embodiment is disclosed with respect to FIGS. 3A-3D, and a third embodiment is disclosed with respect to FIGS. 4A-4C.

Figure 2A:
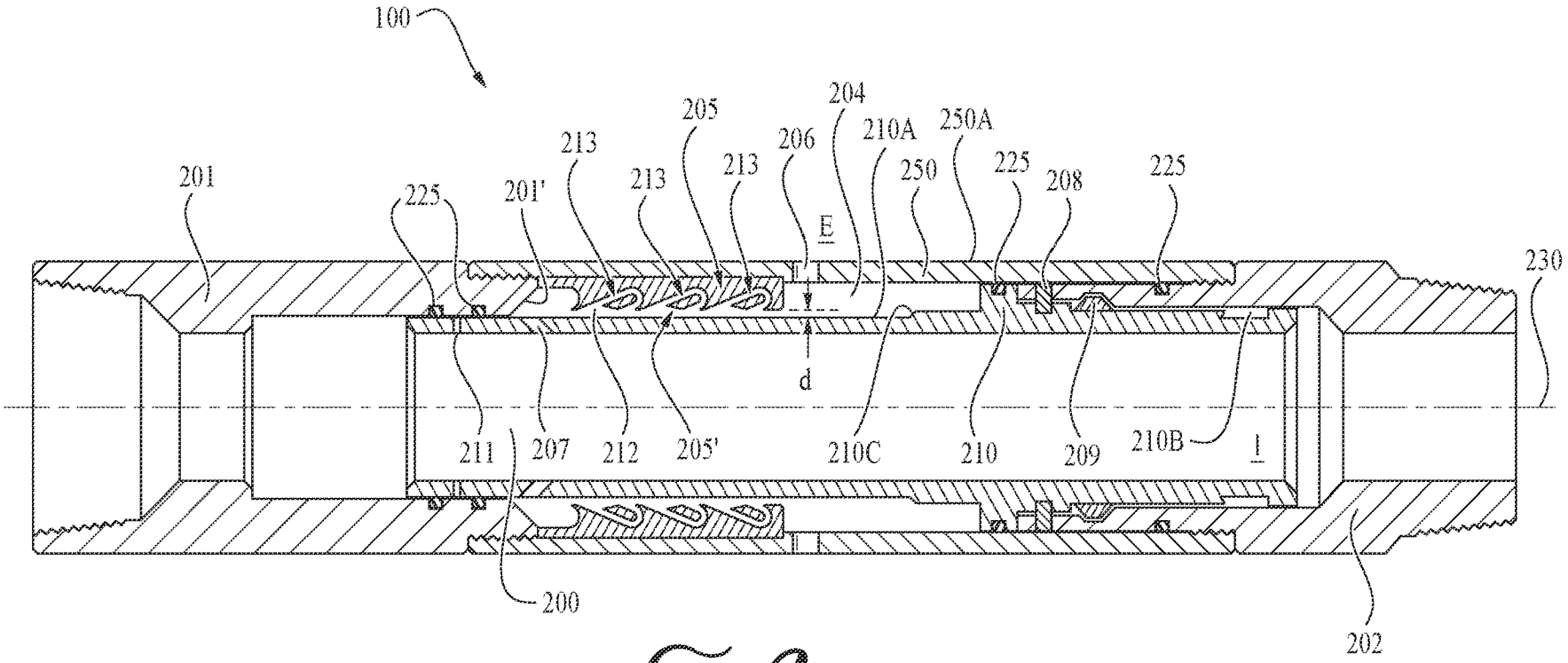
FIG. 2A is a partial cut-away view of a first embodiment of a shifting (e.g., autofill) tool in a first configuration.
Figure 3A:
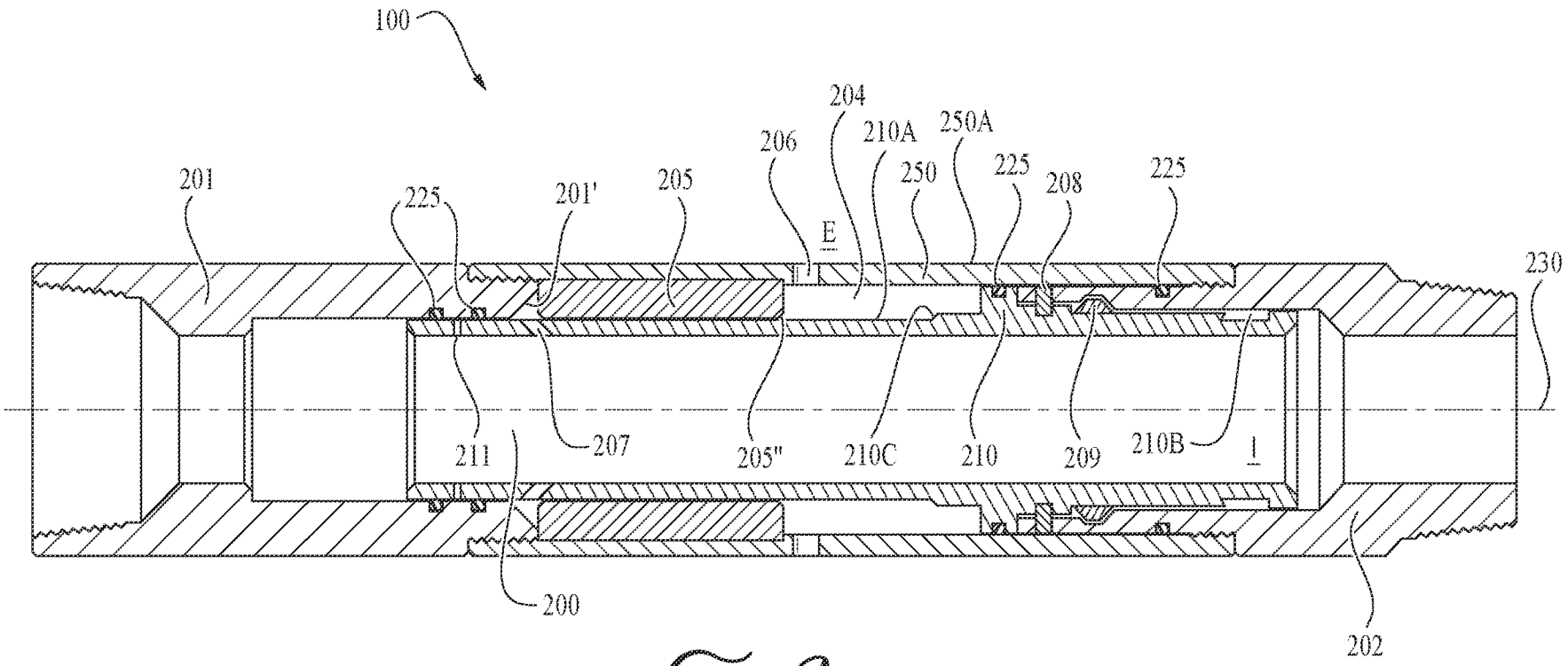
FIG. 3A is a partial cut-away view of a second embodiment of a shifting (e.g., autofill) tool in a first configuration.
Figure 4A:
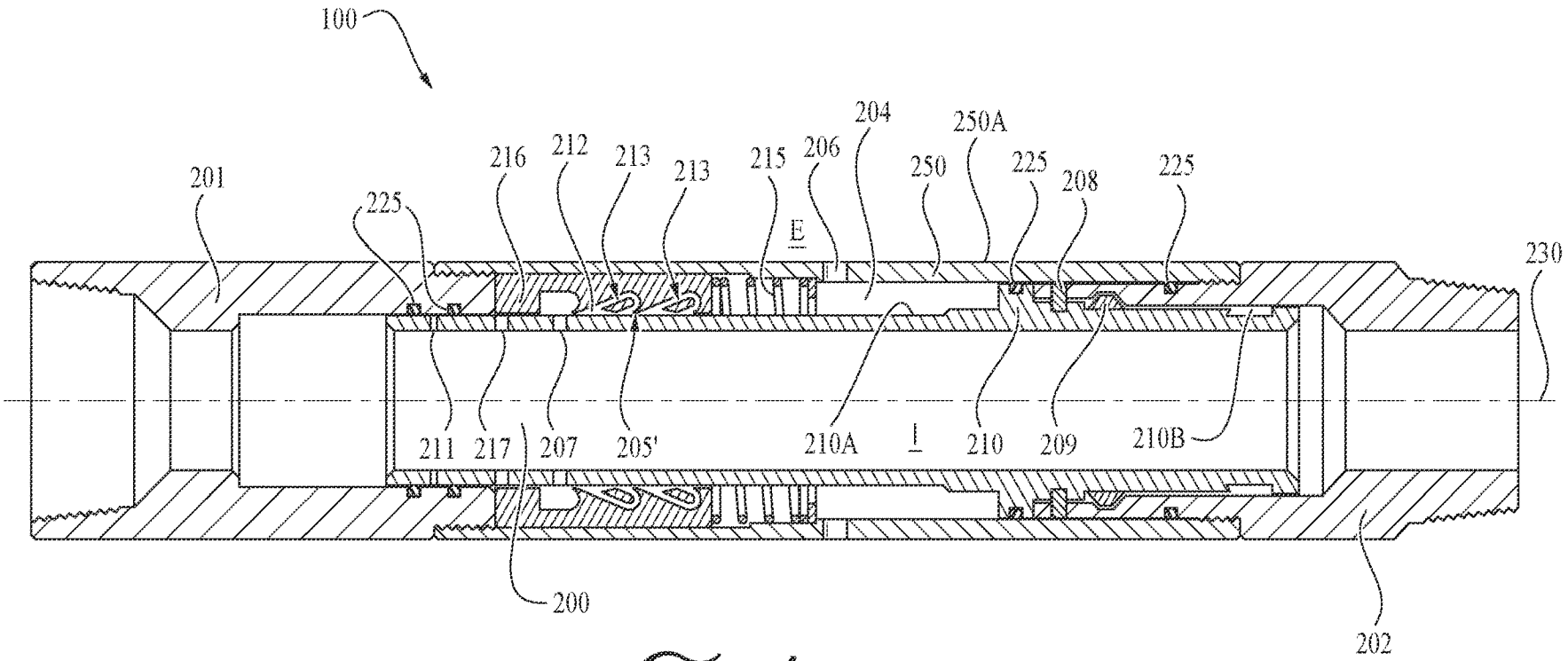
FIG. 4A is a partial cut-away view of a third embodiment of a shifting (e.g., autofill) tool in a first configuration.

Referring to FIGS. 2A, 3A, and 4A, the shifting tool 100 is illustrated in the first configuration. In embodiments, when the shifting tool 100 is in the first configuration, also referred to as a run-in configuration or installation configuration, the shifting tool 100 can be configured so as to allow a route of fluid and/or pressure communication in a first direction, particularly, from the exterior of the shifting tool 100 (e.g., from the well bore 114) to an axial flowbore 200 of the shifting tool 100 and not in a second direction from the axial flowbore 200 of the shifting tool 100 to the exterior of the shifting tool 100. Fluid will still flow from the inside to the outside but at a reduced flow rate due to the restriction caused by the fluidic diode 205'.

In embodiments (e.g., as shown in the embodiments of FIGS. 2A-2B, and FIGS. 3A-3B, as will be disclosed herein), the shifting tool 100 may be configured to transition from the first configuration to the second configuration upon the application of a fluid pressure to the axial flow bore 200 of the shifting tool 100, for example, thereby causing a pressure differential of at least a first threshold pressure (also referred to simply as a "threshold pressure") between the pressure applied within the axial flowbore 200 of the shifting tool 100 and the cavity 204 (i.e., a pressure differential between the ID or interior I of the shifting tool 100 and the OD or exterior E of the shifting tool 100), as will be disclosed herein. When the internal pressure (e.g., the pressure in flow bore 200) is higher than the external pressure (e.g., in cavity 204, exterior E) by enough to shear the shear pin(s) 208, the shear pin(s) 208 will shear and the shifting tool 100 will quickly close. In an alternative embodiment (e.g., in the embodiment of FIG. 4A-4C), the shifting tool 100 may be configured to transition from the first configuration to an intermediate configuration upon the application of a fluid pressure of at least a second or intermediate threshold pressure (also referred to herein as "another threshold pressure") to the axial flowbore 200, and to subsequently transition to the second configuration upon the application of a fluid pressure greater than the first threshold pressure. The use of a lower pressure differential can shift the flow piston 216 into the intermediate configuration (FID. 4B), thus compressing the spring 215 and providing a high resistance to flow from the port 207 in the operating mandrel 210 (this may not be a perfect seal, but can provide a much reduced flow area). Upon exposure to the higher (or first/threshold) pressure differential, the shear pins 208 will be sheared, thus shifting the shifting tool permanently closed (e.g., to the second configuration). The second or intermediate threshold pressure (e.g., the second or intermediate differential pressure) is less than the first threshold pressure. In such embodiments, the first threshold pressure (e.g., the first pressure differential) can be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. The second or "another" threshold pressure (e.g., the second pressure differential) can be at least about 50, 100, 150, 200, 250, 300, 350, or 400 psi less than the first threshold pressure, and can be about 250 psi, about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the first threshold pressure and the second threshold pressure can depend upon various factors, for example, including, but not limited to, the type of well bore servicing operation being implemented.

Figure 2B:
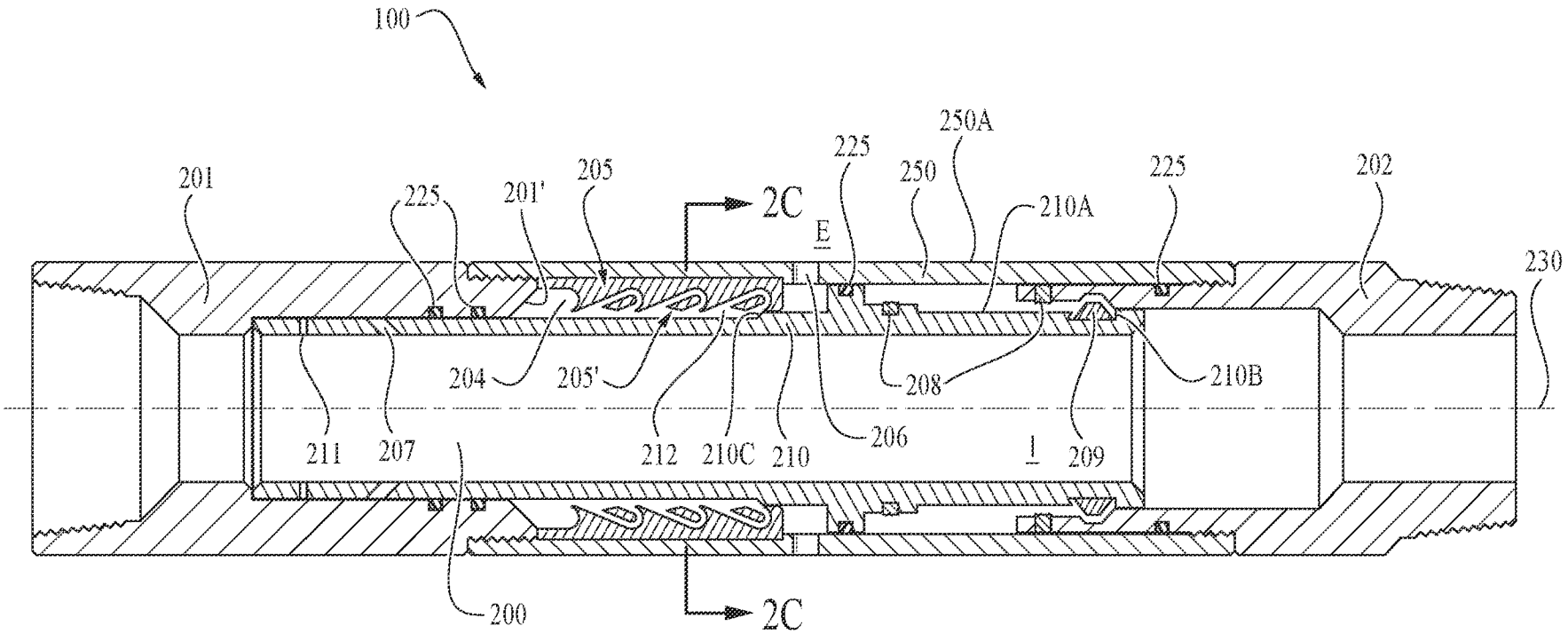
FIG. 2B is a partial cut-away view of the first embodiment of the shifting (e.g., autofill) tool of FIG. 2A in a second configuration.
Figure 2C:
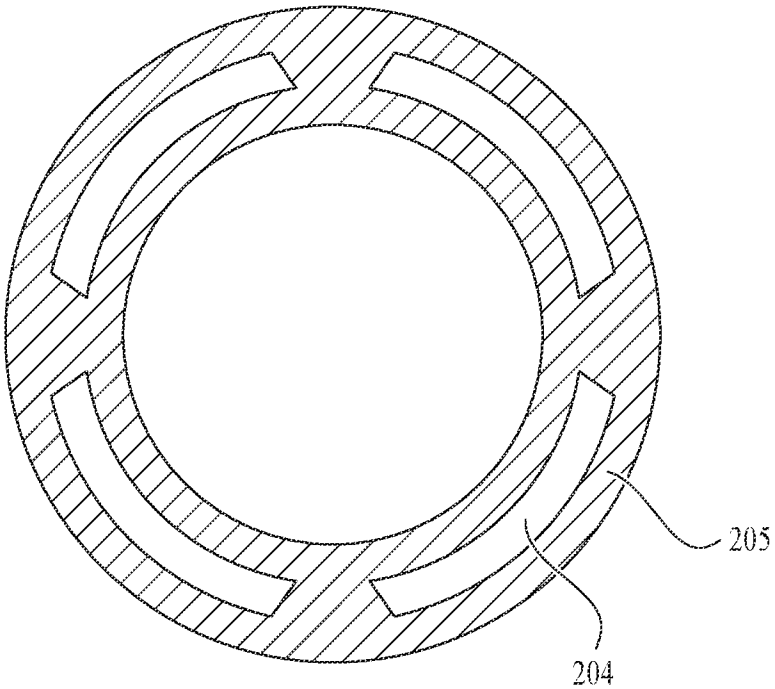
FIG. 2C is a section view along 2C-2C of FIG. 2B.

FIG. 2A is a partial cut-away view of a first embodiment of a shifting tool (e.g., an autofill tool) in a first configuration; FIG. 2B is a partial cut-away view of the first embodiment of the shifting tool (e.g., autofill tool) of FIG. 2A in a second configuration; and FIG. 2C is a section view along 2C-2C of FIG. 2B. With reference to FIGS. 2A-2C, a shifting tool 100 of this disclosure comprises: an operating mandrel 210, a case 250, a flow sleeve 205, a shear pin 208, a snap ring 209, and one or more elastomeric seals 225, each of which will be described in more detail hereinbelow.

Operating mandrel 210 generally defines an axial flowbore 200 and has an outside surface 210A. Operating mandrel 210 comprises an interior port 207 extending therethrough, between the axial flowbore 200 and the outside surface 210A of the operating mandrel 210, and a recess or groove 210B in the outside surface 210A. The recess or groove 210B is configured to receive split snap ring 209, upon transition of the shifting tool from the first configuration to the second configuration.

The case 250 and the operating mandrel 210 are cylindrical in shape and are connected via a top adapter 201 and a bottom adapter 202, thus defining a cavity 204 therebetween. The case 250 comprises an exterior port 206 extending therethrough, between the cavity 204 and exterior 250A of the case 250. Operating mandrel 210 can further include a shoulder 210C on the outside surface 210A thereof, which shoulder 210C can abut flow sleeve 205 in the second configuration to help prevent fluid flow along the flow path delineated below when shifting tool 100 is in a closed (e.g., second) configuration. The case 250 can be threadably coupled with the top adapter 201 and the bottom adapter 202. The top adapter 201 and the bottom adapter 202 can be threadably couplable with the drill string 'above' and 'below' shifting tool 100, respectively. Generally, shifting tool 100 can comprise a greater number of exterior ports 206 than interior ports 207. For example, in embodiments, shifting tool 100 comprise 1, 2, 3, 4, 5, 6, 7, 8, 9, or 10 or more times as many exterior ports 206 as interior ports 207. Exterior ports 206 can be larger than interior ports 207 to further facilitate flow from the exterior E of the shifting tool 100 to the interior I thereof, and restrict flow in the opposite direction. However, in embodiments, the interior port(s) 207 and the exterior port(s) 206 can be approximately the same size, such that any debris that makes it through one should make it through the other. There can be a greater number of exterior port(s) 206 relative to a number of interior port(s) 207, such that the exterior port(s) 206 provide very little resistance to fluid flow (e.g., during run-in). Should the OD of the shifting tool 100 be resting on the bottom side of the well, some of the exterior port(s) 206 may be "plugged" by the casing, so a number of exterior port(s) can be utilized. The actual hole size utilized for both the ID and OD ports (e.g., exterior port(s) 206 and interior port(s) 207) may be based on the smallest passageway inside the shifting tool 100. In embodiments, the exterior port(s) 206 can be smaller than interior port(s) 207. Additionally or alternatively, as shown in the figures, interior flow port(s) 207 can be angled and can optionally introduce fluid passing therethrough from flow bore 200 to impede against a solid surface (such as end 201' of top adapter 201) and further restrict flow (in addition to the restriction provided by the fluidic diode(s) 205' of the flow sleeve 205) from interior I of shifting tool 100 to exterior E of shifting tool 100.

A flow sleeve 205 is positioned within the cavity 204. The flow sleeve 205 comprises a fluidic diode 205' (or a plurality of fluidic diodes 205', as described with reference to FIG. 3C hereinbelow) designed to facilitate flow along a flow path in a direction from the exterior port 206 to the interior port 207 along the flow sleeve 205 and restrict flow along the flow path in an opposite direction from the interior port 207 to the exterior port 206 along the flow sleeve 205. A variety of possible flow sleeves 205 will be described hereinbelow. In embodiments, the flow sleeve 205 is a 3D printed flow sleeve. The flow sleeve 205 an be separated from outside surface 210A of operating mandrel 210 by a distance d, which can be selected to restrict flow under the flow sleeve 205/allow the fluidic diode 205 to restrict flow in the one direction, and can be large enough that it does not plug up during operation.

Shear pin 208 releasably couples the case 250 to the operating mandrel 210. The shear pin can directly or indirectly couple the case 250 to the operating mandrel 210, for example via the bottom adapter 202. Shear pin 208 is designed to snap, shear, or otherwise break and cease coupling of the case 250 to the operating mandrel 210 upon exposure to a differential pressure greater than a first threshold pressure, as described further below. Although described as a "shear pin", other couplers designed to release coupling of case 250 from operating mandrel 210 upon application of a pressure differential can be utilized and are within the scope of this disclosure.

Snap ring 209 is adjacent the outside surface 210A of the mandrel 210, and is positioned such that snap ring 209 inserts itself into recess or groove 210B of operating mandrel 210 when the shifting tool shifts from the first configuration to the second configuration. The snap ring can be a C-shape or split snap ring, in embodiments, and can have any suitable cross-section, such as trapezoidal, as depicted in the figures. Desirably, snap ring is biased to snap into recess or groove 210B when recess or groove 210B shifts to be adjacent thereto. Although described as a "snap ring", other components designed to hold operating mandrel 210 in the closed or second configuration position can be utilized and are within the scope of this disclosure. In embodiments, shifting tool 100 can be configured without a snap ring 209, such that if the pressure becomes higher outside the tool again, the shifting tool 100 could reopen (e.g., transition back to the first configuration). This could be desirable, for example, if the closure is only needed to operate another tool, but then it needs to be opened again for later operations. With the shear pin 208 already sheared, the shifting tool 100 could re-close relatively easily the subsequent time. The shear pin 208 could be replaced, in embodiments, with a snap ring 209 to provide some resistance up to a certain pressure, but it could be reused and reset when the shifting tool 100 would be functioned back open a second or subsequent times.

Shifting tool 100 can further comprise one or more elastomeric seals 225, configured to prevent fluid ingress into the cavity 204 other than via the interior port 207 and the exterior port 206. A bypass (or "equalizing") hole 211 can be positioned between pairs of redundant seals, in embodiments, to prevent air chamber therebetween. Redundant seals can be utilized to ensure operation even should a first of the redundant seals 225 fail.

Figure 3B:
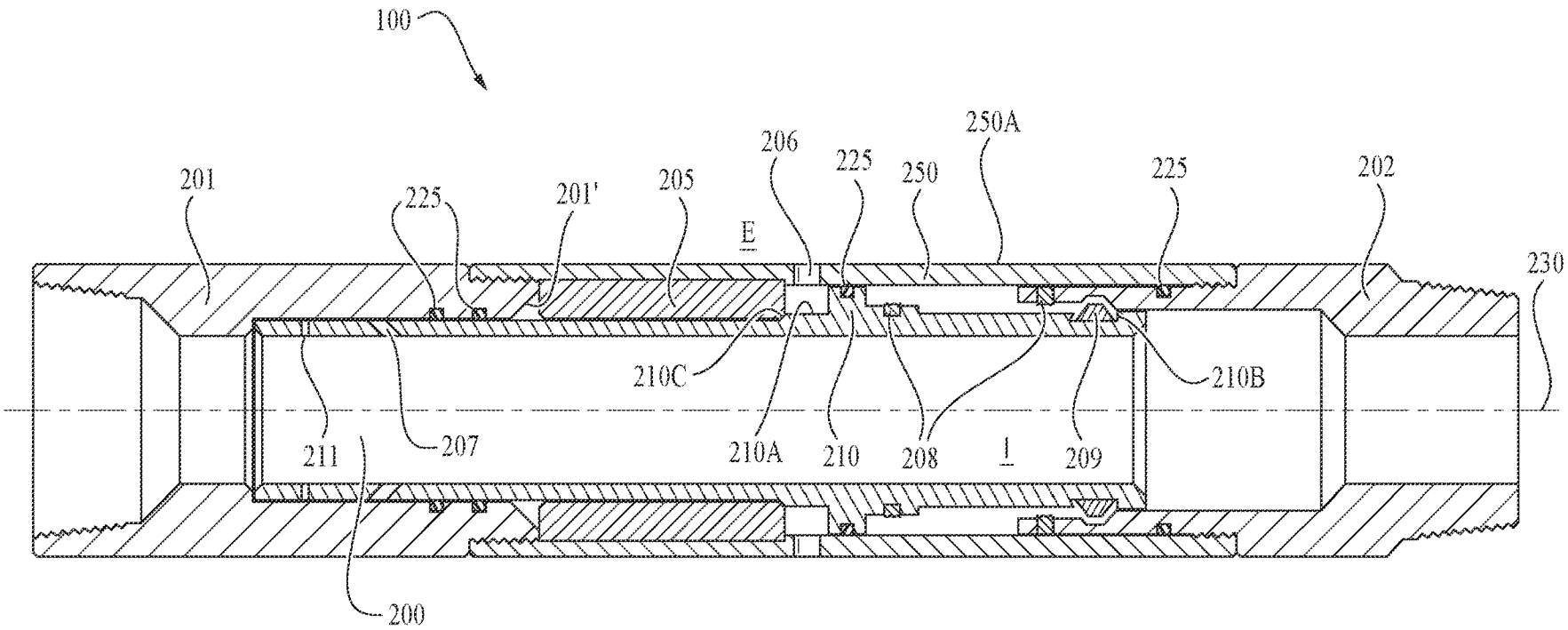
FIG. 3B is a partial cut-away view of the second embodiment of the shifting (e.g., autofill) tool of FIG. 3A in a second configuration.

In a first configuration of the shifting tool, as depicted in FIG. 3A, FIG. 4A, and FIG. 5A, a flow path extends from the exterior E of the case 250, via the exterior port 206, along (e.g., across or through) the flow sleeve 205, and, via the interior port 207, to the flow bore 200 of the operating mandrel 210. Upon exposure to a pressure differential between the cavity 204 and the flow bore 200 above a threshold pressure differential, the shear pin 208 breaks, such that the shifting tool 100 assumes a second configuration, as depicted in FIGS. 2B, 3B, and 4C. In embodiments, part of the shear pin 208 can remain in bottom adapter 202 and/or case 250, and another part remain in operating mandrel 210, as depicted in FIG. 2B, which labels each such part 208. In the second configuration, as depicted in FIG. 2B, FIG. 3B, and FIG. 4C, the operating mandrel 210 has shifted longitudinally along a central axis 230 of the shifting tool 100 (toward top adapter 201) whereby the snap ring 209 lines up longitudinally with and thus extends into ("snaps" down into) the recess or groove 210B in the outside surface 210A of the operating mandrel 210, thus holding the operating mandrel 210 and shifting tool 100 in the second or closed configuration.

The fluidic diode(s) 205' enable a much reduced flow rate of fluid pumped by pumping system 107 from fluid source 105 to be sufficient to operate shifting tool 100 without restricting flow in the preferred direction (from exterior E of shifting tool 100 to interior I of shifting tool 100). This reduction in flow rate is desired, as it can reduce the velocity (and/or amount) of fluid pumped into the well after the shifting tool 100 has been actuated (e.g., has transitioned from the first configuration (e.g., run-in) to the second (e.g., closed) configuration), and can prevent an undesirable "water hammer" effect caused by the closing of the shifting tool 100 at a high flow rate, or the pressurizing up to an undesirably higher pressure at which another downhole tool may be inadvertently actuated. For example, the shifting tool 100 can be a distance (e.g., 5 miles) away from the pump 107, so to operate the shifting tool 100, the pump rate can be increased until the shifting tool 100 closes (e.g., assumes the second configuration). The only indication of the sifting tool 100 closing may be a sudden pressure increase. Even at the sonic velocity of water, it will take well over a second per mile of distance for any indication to get to the surface 104. Further delays due to pressure response of a pressure gauge, time to determine it is a pressure increase, time to shut down the pump 107, and then the time required for the rotary momentum of the pump 107 to finally slow down to a stop. During all this time the pump 107 can be continuing to add volume/pressure to the workstring. There could be, for example, 15-20 seconds between the downhole valve/shifting tool 100 closing and the pump 107 halting even with a very observant pump operator. Accordingly, enabling the use of a lower flow rate to close the shifting tool 100 can be desirable. In embodiments, the fluid from fluid source 105 can be pumped into axial flow bore 115 (and flow bore 200) at a flow rate of less than or equal to about 4, 3, 2, 1, or 0.5 barrels per minute (BPM).

In embodiments, the operating mandrel 210 can be connected with another component, such that the longitudinal shifting of the operating mandrel 210 axial displaces or otherwise actuates the another component. By way of non-limiting example, the another tool can comprise a ball valve. Other components that can be actuated or axially displaced via the shifting tool 100 of this disclosure will be apparent to those of skill in the art and with the help of this disclosure.\

In embodiments, the shifting tool is an autofill tool. In such embodiments, in the first configuration, flow is allowed along the flow path while, in the second configuration, flow is disallowed along the flow path. Although, as noted above, the shifting tool can be utilized in a variety of operations to actuate another tool and/or axially displace another component, the following description may be described with reference to a shifting tool 100 that is an autofill tool or valve.

In embodiments, when the shifting tool functions (e.g., transitions from the first or intermediate configuration to the second configuration), it could then activate an annulus to tubing pressure operated tool. For example, annulus pressure operated equipment may be utilized early in a job where an upper ball valve is to remain closed. Late in the job, it may be desirable for this upper ball valve to open. Accordingly, in embodiments, the sliding of the operating mandrel 210 could allow such a ball valve tool to now see the differential pressure from the outside to the inside, and function when desired.

With reference to the embodiments of FIGS. 1A-1C, in embodiments, the fluidic diode 205' of the flow sleeve 205 comprises a plurality of chambers 213, with three flow chambers 213 depicted in FIGS. 1A-1C. The flow sleeve 205 can comprise any number of flow chambers, for example, from 1 to 10 chambers, from 1 to 5 chambers, from two to ten chambers, or greater than or equal to 1, 2, 3, 4, 5, 6, 7, 8, 9, or 10 chambers, and/or less than or equal to about 10, 9, 8, 7, 6, 5, 4, 3, 2, or 1 chamber. During run-in, when the shifting tool is in the first configuration (e.g., FIG. 1A), flow along the flow path from the exterior E of the shifting tool 100 to the flow bore 200 of the shifting tool 100 is relatively unimpeded by the presence of the flow sleeve. When the shifting tool reaches a desired location in the wellbore 114, fluid can be introduced from fluid source 105 and pumping system 107 into axial flow bore 115. Upon introduction of fluid and thus pressure into the flow bore 200, via pumping of the fluid from fluid source 105 and pump(s) 107, the fluid flowing from the flow bore 200 through interior port 207 encounters the chambers 213 of the fluidic diode 205', which impedes the flow of fluid along the flow path from the interior flow port 207 to the exterior flow port 206 along the flow sleeve 205. When the differential pressure is sufficient to break the shear pin(s) 208, shifting tool 100 transitions from the first (e.g., run-in) configuration (e.g., FIG. 2A) to the second (e.g., closed) configuration (e.g., FIG. 2B). In the second configuration, flow (in either direction) along the flow pathway is prevented. In embodiments, in the second (closed) configuration of the shifting tool 100, shoulder 210C if mandrel 210 can abut flow sleeve 205 (e.g., a shoulder 205" thereof), thus preventing fluid flow.

FIG. 2C depicts a section view along 2C-2C (the middle chamber 213) of FIG. 2B. In embodiments, the chambers 213 can be offset about a circumference of the shifting tool 100.

Figure 3C:
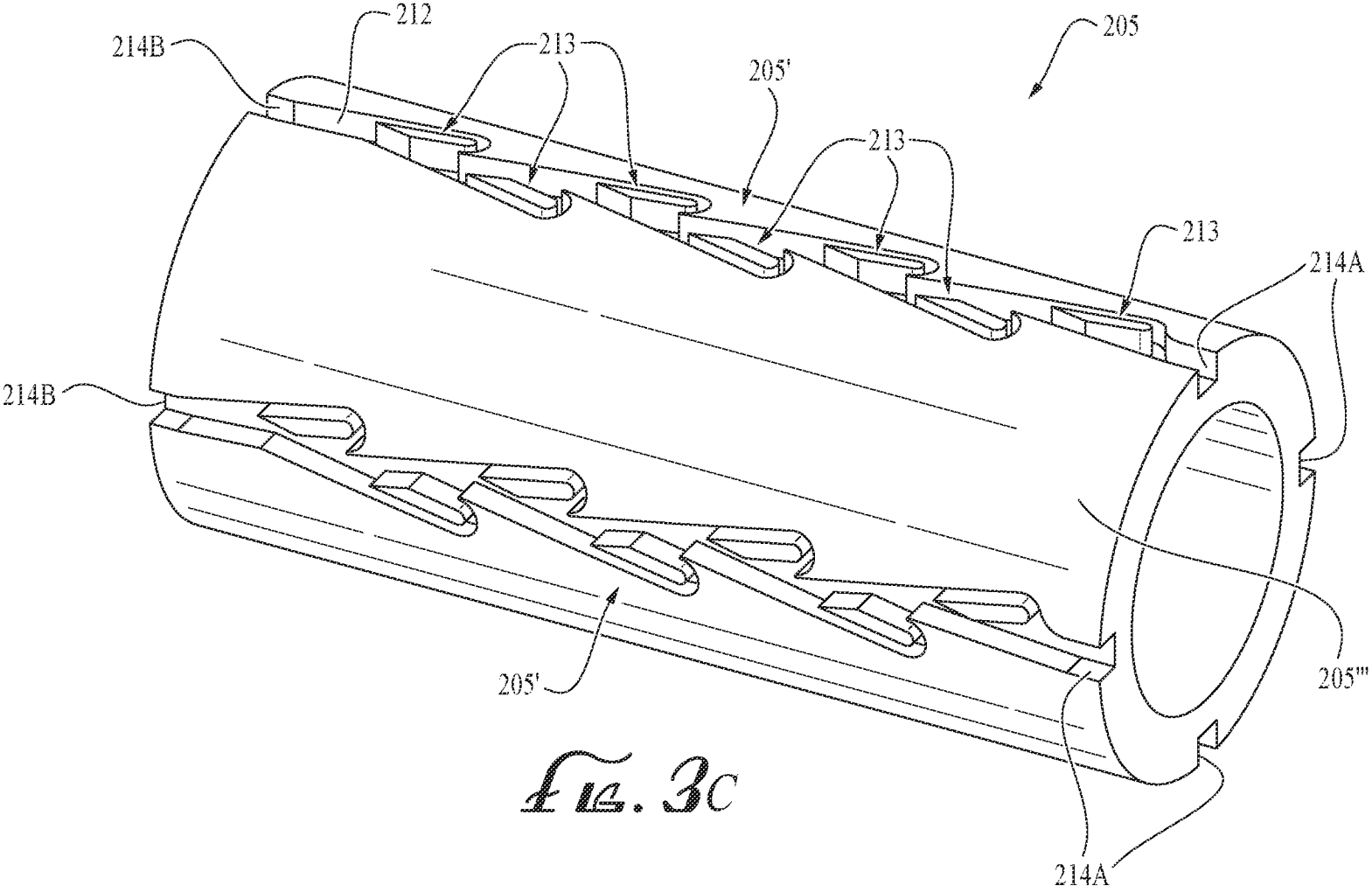
FIG. 3C is a schematic side view of a flow sleeve, suitable for use in the second embodiment, according to embodiments of this disclosure.
Figure 3D:
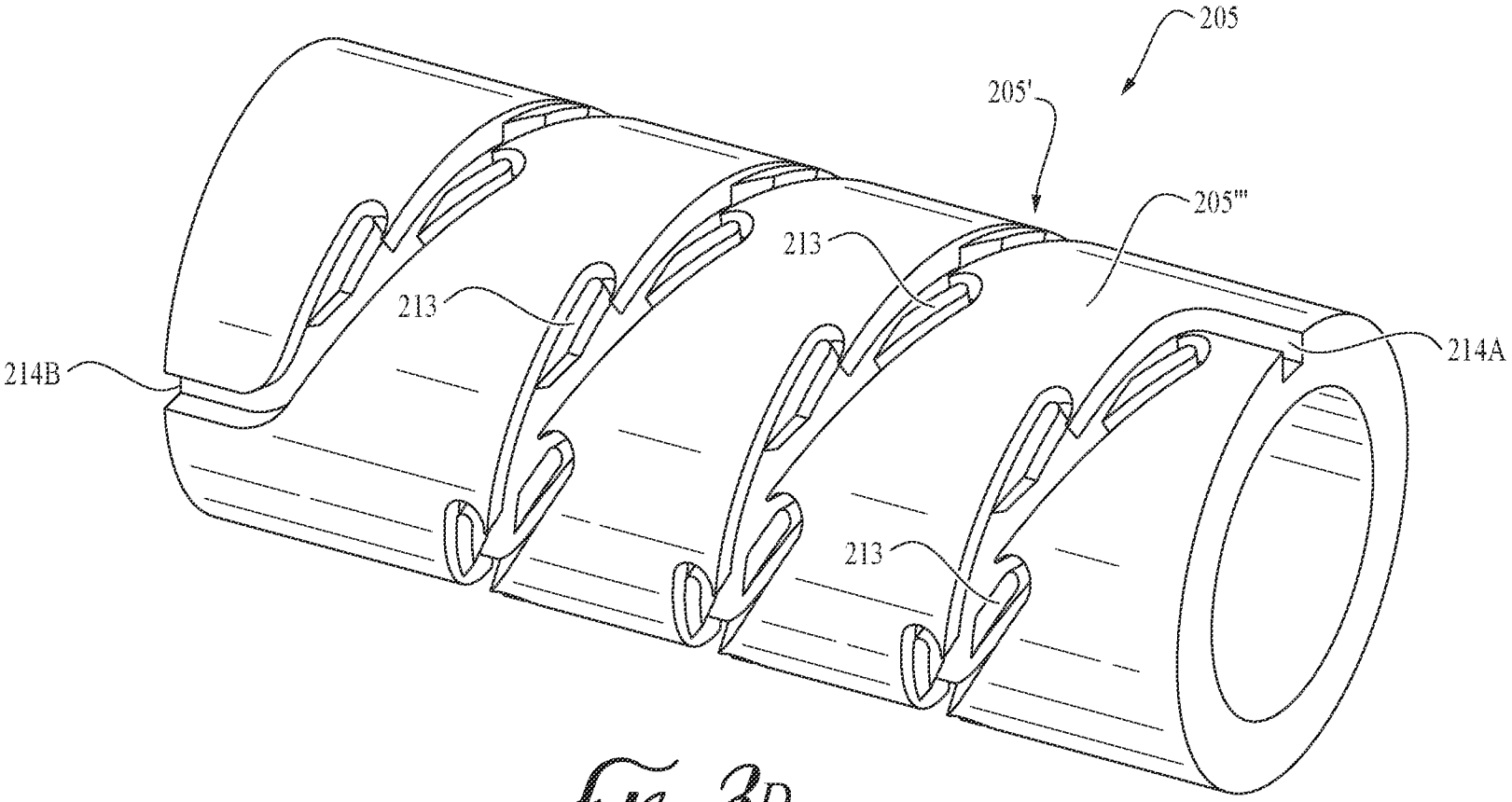
FIG. 3D is a schematic side view of another flow sleeve, suitable for use in the second embodiment, according to embodiments of this disclosure.

FIG. 3A is a partial cut-away view of a second embodiment of a shifting tool (e.g., an autofill tool) 100 in a first (e.g., run-in) configuration, FIG. 3B is a partial cut-away view of the second embodiment of the shifting tool (e.g., autofill tool) of FIG. 3A in a second (e.g., closed) configuration, FIG. 3C is a schematic side view of a flow sleeve, suitable for use in the second embodiment, according to embodiments of this disclosure, and FIG. 3D is a schematic side view of another flow sleeve, suitable for use in the second embodiment, according to embodiments of this disclosure. With reference now to FIGS. 3A-3D, in embodiments, the flow sleeve 205 comprises a solid cylinder, an outside surface 205" of which is milled with or otherwise provides the fluidic diode(s) 205'. In embodiments, such as depicted in FIG. 3C, the outside surface 205" provides a plurality of fluidic diodes 205', wherein each fluidic diode 205' provides a flow path 212 from an first inlet or opening 214A to a second inlet or opening 214B of the fluidic diode 205'. A flow path comprising a pattern such as that depicted in FIG. 3C is commonly referred to as a Tesla pattern, Tesla design, or Tesla valve. In alternative embodiments, such as depicted in FIG. 3D, the outside surface 205'" provides a single fluidic diode 205' (e.g., a single Tesla valve) that provides a flow path 212 that wraps around the flow sleeve 205 a plurality of times from a first inlet or opening 214A to a second inlet or opening 214B of the fluidic diode 205'. The fluidic diode 205' can include a plurality of chambers 213, only a few of which are labeled in FIG. 3D for clarity.

Figure 4B:
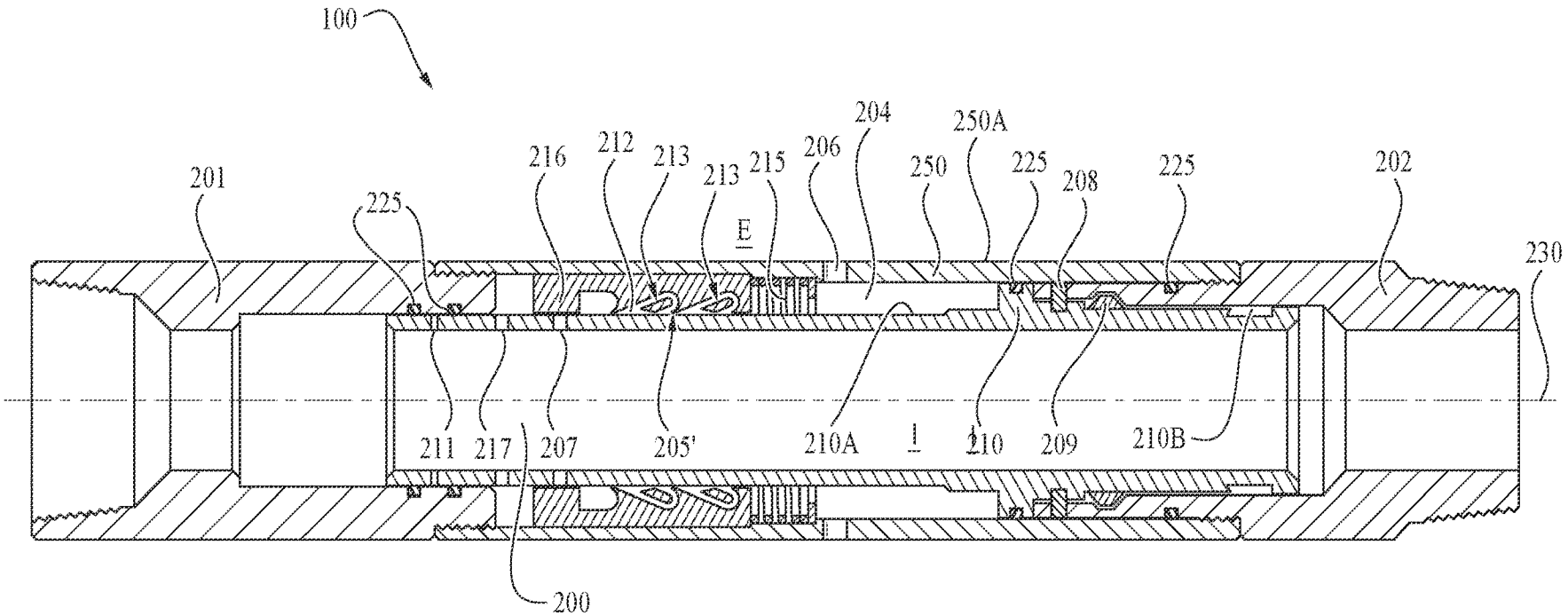
FIG. 4B is a partial cut-away view of the third embodiment of the shifting (e.g., autofill) tool of FIG. 4A in an intermediate configuration.
Figure 4C:
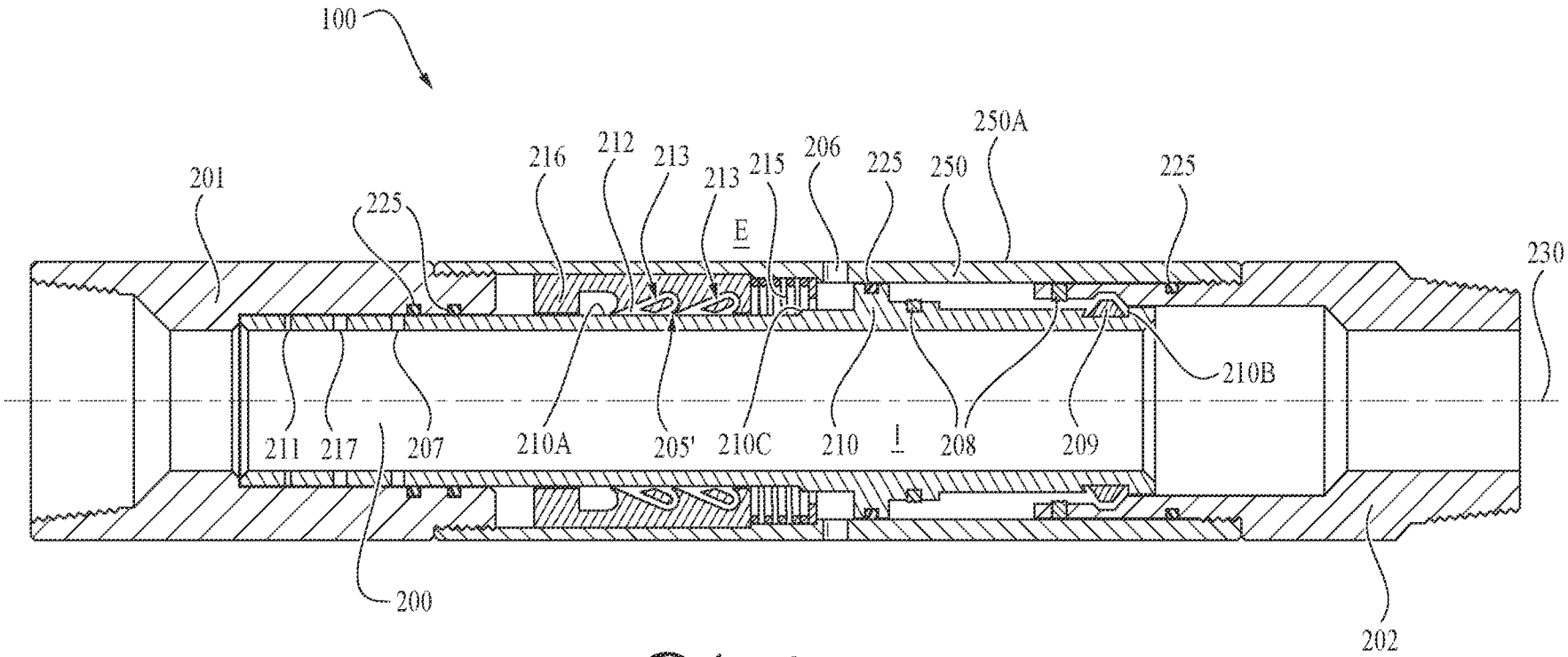
FIG. 4C is a partial cut-away view of the third embodiment of the shifting (e.g., autofill) tool of FIG. 4A in a second configuration.

FIG. 4A is a partial cut-away view of a third embodiment of a shifting tool (e.g., an autofill tool) 100 in a first (e.g., run-in) configuration, FIG. 4B is a partial cut-away view of the third embodiment of the shifting tool (e.g., autofill tool) of FIG. 4A in an intermediate (e.g., partially closed/semi-restricted flow) configuration, and FIG. 4C is a partial cut-away view of the third embodiment of the shifting tool (e.g., autofill tool) of FIG. 4A in a second (e.g., closed) configuration. With reference now to FIGS. 4A-4C, in embodiments, the flow sleeve 205 comprises a spring 215 and a flow piston 216. The flow sleeve 205 from any of the previous embodiments can be utilized as the flow piston 216, so long as the flow piston 216 can provide a restricting area that cuts off the majority of the flow from the operating mandrel 210 interior flow port(s) 207. The flow piston 216 is longitudinally situated in the cavity 204 between the top adapter 201 and the spring 215. In the first configuration (FIG. 4A), a pressure port 217 extending from the outside surface 210A of the operating mandrel 210 to the flow bore 200 thereof (e.g., the pressure port 217 extends from a radially inner surface of the operating mandrel 210 to a radially outer surface 210A of the operating mandrel 210) is covered/blocked by the flow piston 216. In an intermediate configuration, as depicted in FIG. 2B, upon exposure to a pressure differential between the cavity 204 and the flow bore 200 above another or second or intermediate threshold pressure differential, but below the first or threshold pressure differential, the flow piston 216 shifts longitudinally toward and compresses the spring 215, such that the interior flow port 207 is at least partially covered or blocked by the flow piston 216 and the pressure port 217 is unobstructed by the flow piston 216. The pressure port 217 can be exposed in the intermediate configuration (e.g., not covered or blocked by flow piston 216), thus holding the flow piston 216 over the interior flow port 207. In the second configuration, as depicted in FIG. 4C, the operating mandrel 210 has shifted longitudinally and sheared the shear pin(s) 208 along central axis 230 of the shifting tool 100 toward top adapter 201 whereby the snap ring 209 lines up longitudinally with and thus extends into the recess or groove 210B in the outside surface 210A of the operating mandrel 210, thus holding the operating mandrel 210 and shifting tool 100 in the second (e.g., closed) configuration.

Fluidic diode 205' is a passive device that provides a lower flow resistance along flow path 212 in a first (e.g., a preferred) direction (e.g., from outside flow port(s) 206 to inside flow port(s) 207) than along flow path 212 in a second, opposite direction (e.g., from inside flow port(s) 207 to outside flow port(s) 206). The fluidic diode 205' thus provides a lower (e.g., a low or very low) resistance in the preferred direction along flow path 212 and, depending on the design, provides a relatively higher (e.g., a high or very high) resistance in the opposite direction (e.g., relative to the resistance in the preferred direction along the flow path 212). A few fluidic diodes 205' have been shown and described hereinabove with reference to the figures. However, it is to be understood that a wide variety of fluidic diode 205' designs can be incorporated in a flow sleeve 205 of a shifting tool 100 in accordance with this disclosure. As long as the flow sleeve 205 is positioned in cavity 204 and provides a substantially reduced flow thereover along the flow path 212 in one direction versus in the reverse direction, it can be considered to contain a fluidic diode 205' as per this disclosure. However, a few additional examples of suitable flow sleeve designs incorporating fluidic diode(s) 205' will be enumerated below. For example, and without limitation, in embodiments, the fluidic diode(s) 205' is designed substantially as described in U.S. Pat. No. 1,329,559 to Tesla, the disclosure of which is hereby incorporated herein for purposes not contrary to this disclosure (also referred to as a Tesla design, Tesla pattern, or Tesla valve). In embodiments, the fluidic diode(s) 205' and/or the shifting tool 100 can include designs wherein: (1) flow from the ID or interior I through interior port 207 impacts a shoulder perpendicularly; (2) flow from the ID or interior I through interior port 207 imparts a spin of the fluid making it more difficult for it to move on; (3) flow from the ID or interior I through interior port 207 can impart two different directions of spin so the flow impacts upon itself, as in the embodiments of FIGS. 2A-2C and 3A-3D; (4) flow from the ID or interior I through interior port 207 can be exposed to an enlarged area that spins the flow in the opposite direction, thus impacting the rest of the flow (e.g., multiple chambers that spin the flow in opposite directions); (5) flow from the ID or interior I through interior port 207 can move a piston to pinch off the flow causing an even greater flow restriction, as described with respect to FIGS. 4A-4C. A floating piston with the fluidic diode 205' profile on the ID can be utilized with an autofill shifting tool 100 to pinch off the flow quickly and not require a very high flowrate to actuate the tool (i.e., move from the first configuration to the second configuration). In embodiments, the fluidic diode(s) 205' include fluidic diode(s) 205' designed as a "wing" array and/or as a "pocket" array.

The use of the fluidic diode(s) 205' can allow for a larger exterior port 207 from the OD to the ID to reduce the chance of plugging, while greatly decreasing the flow rate from the ID to the OD that is utilized to operate the shifting tool 100 (e.g., to shift from the first configuration to the second configuration).

In embodiments, a downhole tool 100 of this disclosure comprises a cylindrical tool body having an exterior surface (e.g., outside surface 250A) and an interior surface (e.g., outside surface 210A) defining a central flow bore 200 having a central axis 230, a fluid flow path 212 disposed within the tool body, the fluid flow path having a first port (e.g., interior port 207) disposed in the interior surface (210A) and in fluid communication with the flow bore 200 and a second port (e.g., exterior port 206) disposed in the exterior surface 250A and in fluid communication with an exterior E of the tool 100, and a fluidic diode 205' disposed within the fluid flow path 212, wherein the fluidic diode 205' provides increased resistance to fluid flowing from the first port 207 through the flow path 212 to the second port 206 in comparison to a resistance to fluid flowing from the second port 206 through the flow path 212 to the first port 207. The downhole tool can further comprise an actuatable member (e.g., operating mandrel 210) configured to actuate responsive to the increased resistance to fluid flowing from the first port 207 though the flow path 212 to the second port 206. In embodiments, the actuatable member comprises a cylindrical sleeve (e.g., operating mandrel 210), and wherein the cylindrical sleeve (e.g., operating mandrel 210) moves along the central axis 230 responsive to an increase in pressure within the central flow bore 200. The cylindrical sleeve (e.g., operating mandrel 210) can move along the central axis 230 a distance effective to seal the first port (e.g., interior flow port 207), the second port (e.g., exterior flow port 206), or both.

Also disclosed herein is a wellbore system 180 comprising: a tubular string 150 disposed within a wellbore 114; and a shifting tool 100, as described herein, incorporated within the tubular string 150. As detailed herein, the shifting tool 100 can comprise: an operating mandrel 210 generally defining an axial flowbore 200 and having an outside surface 210A, wherein the operating mandrel 210 comprises an interior port 207 extending therethrough between the axial flowbore 200 and the outside surface 210A of the operating mandrel 210, and a recess or groove 210B in the outside surface 210A; a case 250, wherein the case 250 and the operating mandrel 210 are cylindrical and are connected via a top adapter 201 and a bottom adapter 202, thus defining a cavity 204 therebetween, and wherein the case 250 comprises an exterior port 207 extending therethrough between the cavity 204 and exterior E of the case 250; a flow sleeve 205 positioned within the cavity 204, wherein the flow sleeve 205 comprises a fluidic diode 205' designed to facilitate flow in a direction from the exterior port 206 to the interior port 207 along the flow sleeve 205 and restrict flow in the opposite direction from the interior port 207 to the exterior port 206 along the flow sleeve 205; a shear pin 208 releasably coupling the case 250 to the operating mandrel 210; a snap ring 209 adjacent the outside surface 210A of the mandrel 210; and (optionally) one or more elastomeric seals 225 configured to prevent fluid ingress into the cavity 204 other than via the interior port 207 and the exterior port 206, wherein, in a first configuration of the shifting tool 100, a flow path extends from the exterior of the case 250, via the exterior port 206, along (e.g., across or through) the flow sleeve 205, and, via the interior port 207, to the flow bore 200 (e.g., the interior I) of the operating mandrel 210, and wherein, upon exposure to a pressure differential between the cavity 204 and the flow bore 200 above a threshold pressure differential, the shear pin 208 breaks, such that the shifting tool 100 assumes a second configuration in which the operating mandrel 210 has shifted longitudinally along a central axis 230 of the shifting tool 100 whereby the snap ring 209 extends into the recess or groove 210B in the outside surface 210A of the operating mandrel 210, thus holding the operating mandrel 210 in the second configuration. The shifting tool 100 can be as configured in any of the embodiments of the drawings 2A-4C described hereinabove.

As noted herein, the shifting tool 100 utilized in the wellbore system 180 can be an autofill tool, wherein, in the first configuration, flow is allowed along the flow path and, in the second configuration, flow is disallowed along the flow path. Alternatively, the shifting tool 100 utilized in the wellbore system 180 can be utilized to actuate another downhole tool/axially displace another component, as noted hereinabove.

The wellbore system 180 can further comprise: a packer 170 disposed about the tubular string 150 and up-hole relative to the shifting tool 100; and/or a plug 160 incorporated with the tubular string 150 and down-hole relative to the shifting tool 100.

Also provided herein is a method comprising: positioning a tubular string 150 comprising a shifting tool 100 within a wellbore 114, wherein the shifting tool is a shifting tool 100 as described hereinabove. In embodiments, the shifting tool 100 comprises an operating mandrel 210 generally defining an axial flowbore 200 and having an outside surface 210A, wherein the operating mandrel 210 comprises an interior port 207 extending therethrough between the axial flowbore 200 and the outside surface 210A of the operating mandrel 210, and a recess or groove 210B in the outside surface 210A; a case 250, wherein the case 250 and the operating mandrel 210 are cylindrical and are connected via a top adapter 201 and a bottom adapter 202, thus defining a cavity 204 therebetween, and wherein the case 250 comprises an exterior port 207 extending therethrough between the cavity 204 and exterior E of the case 250; a flow sleeve 205 positioned within the cavity 204, wherein the flow sleeve 205 comprises a fluidic diode 205' designed to facilitate flow in a direction from the exterior port 206 to the interior port 207 along the flow sleeve 205 and restrict flow in the opposite direction from the interior port 207 to the exterior port 206 along the flow sleeve 205; a shear pin 208 releasably coupling the case 250 to the operating mandrel 210; a snap ring 209 adjacent the outside surface 210A of the mandrel 210; and (optionally) one or more elastomeric seals 225 configured to prevent fluid ingress into the cavity 204 other than via the interior port 207 and the exterior port 206, wherein, in a first configuration of the shifting tool 100, a flow path extends from the exterior of the case 250, via the exterior port 206, along (e.g., across or through) the flow sleeve 205, and, via the interior port 207, to the flow bore 200 (e.g., the interior I) of the operating mandrel 210, and wherein, upon exposure to a pressure differential between the cavity 204 and the flow bore 200 above a threshold pressure differential, the shear pin 208 breaks, such that the shifting tool 100 assumes a second configuration in which the operating mandrel 210 has shifted longitudinally along a central axis 230 of the shifting tool 100 whereby the snap ring 209 extends into the recess or groove 210B in the outside surface 210A of the operating mandrel 210, thus holding the operating mandrel 210 in the second configuration. The shifting tool 100 can be positioned within the wellbore 114 in the first (e.g., run-in) configuration. The method can further comprise exposing the shifting tool 100 to a pressure differential greater than or equal to the first or threshold pressure, whereby the shifting tool 100 transitions to the second (e.g., closed) configuration in response to the pressure differential greater than the first threshold pressure.

In embodiments of the method, the shifting of the operating mandrel 210 can be utilized to axially displace and/or actuate another tool. By way of nonlimiting example, the another tool can comprise a ball valve, in embodiments. The shifting tool 100 can thus be operable to open or close the ball valve upon transition of the shifting tool 100 to the second configuration. Alternatively, in embodiments, the shifting tool 100 comprises an autofill tool, wherein, in the first configuration, flow is allowed along the flow path and, in the second configuration, flow is disallowed along the flow path. In such embodiments, the shifting tool 100 can be utilized to allow flow from the exterior port(s) 206, past the flow sleeve 205, and into the flow bore 200 via the interior port(s) 207 while in the first configuration (e.g., during run-in), and can be actuated as described above when at a desired location in the wellbore 114, thus transitioning the shifting tool 100 to the second (e.g., closed) configuration, in which flow along the flow path into the shifting tool 100 is prevented.

In embodiments of the method, the flow sleeve 205 is as depicted, for example, in FIGS. 2A-2C, wherein the flow sleeve comprises a plurality of chambers 213. The chambers can be offset about a circumference of the shifting tool 100 to further impede the flow in the direction from the interior flow port 207 to the exterior flow port 206.

In embodiments of the method, the flow sleeve 205 is as depicted, for example, in FIGS. 3A-3D, wherein the flow sleeve 205 comprises a solid cylinder, an outside surface 205' of which is milled with the fluidic diode(s) 205'. As depicted in FIG. 3C, in embodiments of the method, the outside surface 205''' provides a plurality of fluidic diodes 205', wherein each fluidic diode 205' provides a fluidic diode flow path 212 from an inlet or first opening 214A to an outlet or second opening 214B of the fluidic diode 205'. Alternatively, as depicted in the embodiment of FIG. 3D, in embodiments of the method, the outside surface 205''' provides a single fluidic diode 205' that provides a fluidic diode flow path 212 that wraps around the flow sleeve 205 a plurality of times from an inlet or first opening 214A thereof to an outlet or second opening 214B thereof.

Alternatively, as depicted in the embodiment of FIGS. 4A-4C, in embodiments of the method, the flow sleeve 205 comprises a spring 215 and a flow piston 216, wherein the flow piston 216 is longitudinally situated in the cavity 204 between the top adapter 201 and the spring 215, wherein, in the first configuration, a pressure port 217 extending from the outside surface 210A of the operating mandrel 210 to the flow bore 200 thereof (e.g., wherein the pressure port extends from a radially inner surface or interior I of the operating mandrel 210 to a radially outer surface 210A of the operating mandrel) is covered or blocked by the flow piston 216, and wherein, in an intermediate configuration, upon exposure to a pressure differential between the cavity 204 and the flow bore 200 above another or second threshold pressure differential, but below the first or threshold pressure differential, the flow piston 216 shifts longitudinally toward and compresses the piston, 215 such that the interior flow port 207 is covered by the flow piston 207 and the pressure port 217 is unobstructed by the flow piston 216. In such embodiments, the method can further comprise: exposing the shifting tool 100 to an intermediate pressure differential greater than or equal to the another or second threshold pressure and less than the first or threshold pressure, whereby the shifting tool 100 transitions from the first configuration to the intermediate configuration in response to the another pressure differential. Shifting of the operating mandrel 210 to the intermediate configuration of FIG. 4B can reduce the flow rate of fluid 105 needed to be pumped downhole to transition the shifting tool 100 to the second (e.g. closed) configuration.

The first threshold pressure (also referred to herein simply as the "threshold pressure") needed to break the shear pin 208 can be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. The intermediate or second threshold pressure (also referred to herein as the "another" threshold pressure) needed to move flow piston 216 and compress spring 215 can be any suitable pressure less than (e.g., at least 50, 100, 150, 200, 250, 300, 350, or 400 psi less than) the first or threshold pressure. For example, the second or another threshold pressure can be at least about 250 psi, at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure less than the first or threshold pressure. As will be appreciated by one of skill in the art upon viewing this disclosure, the first, intermediate, and second threshold pressures can depend upon various factors, for example, including, but not limited to, the type of well bore servicing operation being implemented.

Additionally, in embodiments, once the production string 150 comprising the shifting tool 100 has been positioned within the axial flowbore 191 of the completion string 190 and/or the wellbore 114, one or more of the adjacent zones can be isolated and/or the production string 150 can be secured (e.g., within the completion string 190 or the formation 102). In embodiments, the adjacent zones can be separated by one or more suitable wellbore isolation devices. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones can be isolated, alternatively, the zones can remain unisolated. Accordingly, in embodiments, a method of this disclosure comprises running drill string 150 to desired depth with autofill valve shifting tool 100 filling the inside diameter (e.g., the axial flowbore) of the work string 150; once at desired depth, slowly pumping fluid from fluid source 105 via pumps 107 into the string to operate the autofill valve shifting tool 100 closed (e.g., 500 to 1000 psi to operate); continue pumping and build pressure (e.g., up to 4,500 psi or more) to fully set the packer 170; and, when desired to open the formation to flow, fracture the disc of the packer 170 with high pressure (e.g., greater than 5000 psi) or a bar on slickline can be employed to shatter it; and flow/produce from the well. Accordingly, in embodiments, the method can further comprise producing a formation fluid, for example, via the production string 150.

In embodiments, a method of placing the downhole tool according to embodiments described hereinabove into a wellbore 114 penetrating a subterranean formation 102, comprises: attaching the downhole tool (e.g., shifting tool 100) to a conveyance (e.g., a tubular workstring 150 having a flow bore in fluid communication with the central flow bore 200 of the downhole tool (e.g., shifting tool 100)) and placing the downhole tool (e.g., shifting tool 100) into the wellbore 114 such that an annular space 191 is provided between the exterior surface (e.g., outside surface 250A) of the downhole tool (e.g., shifting tool 10) and the wellbore 114; conveying (e.g., running-in or moving downward) the downhole tool (e.g., shifting tool 100) into the wellbore 114, wherein during the conveying fluid in the annular space (e.g., axial flowbore 191) flows from the second port (e.g., exterior port 206) through the flow path 212 to the first port (e.g., interior port 207) and into the central flow bore 200 of the downhole tool (e.g., shifting tool 100) and conveyance; stopping the conveying when the downhole tool (e.g., shifting tool 100) reaches a desired location in the wellbore 114; and actuating (e.g., setting) the downhole tool (e.g., shifting tool 100) by flowing fluid downward from the surface 104 through the flow bore (e.g., axial flow bore 115) of the conveyance and the downhole tool (e.g., shifting tool 100), wherein during the actuating fluid in the flow bore 200 of the downhole tool (e.g., shifting tool 100) flows from the first port (e.g., interior port 207) through the flow path 212 to the second port (e.g., exterior port 206) and into the annular space (e.g., axial flow bore 191), wherein resistance to fluid flow through the flow path 212 during the conveying is less than resistance to fluid flow through the flow path 212 during the actuating.

In embodiments, a method of placing a downhole tool (e.g., shifting tool 100) into a wellbore 114 penetrating a subterranean formation 102, comprises: attaching the downhole tool (e.g., shifting tool 100) to a tubular workstring 150 having a flow bore 115; placing the downhole tool (e.g., shifting tool 100) into the wellbore 114 such that an annular space (e.g., axial flow bore 191) is provided between an exterior surface (e.g., exterior surface 250A) of the downhole tool (e.g., shifting tool 100) and the wellbore 114; running the downhole tool (e.g., shifting tool 100) into the wellbore 114, wherein during run-in fluid flows from the annular space (e.g., axial flow bore 191) through the tool (e.g., shifting tool 100) and into the flow bore 200; stopping the run-in when the downhole tool (e.g., shifting tool 100) reaches a desired location in the wellbore 114; and actuating the downhole tool (e.g., shifting tool 100) by flowing fluid down the flow bore 200 from the surface 104 and through the tool body (e.g., operating mandrel 210) into the annular space (e.g., axial flow bore 191), wherein resistance to fluid flow through the tool (e.g., shifting tool 100) during run-in is less than resistance to fluid flow through the tool (e.g., shifting tool 100) during actuating. An increase in resistance to fluid flow through the tool (e.g., shifting tool 100) during actuating can be provided by a fluidic diode(s) 205' disposed within a fluid flow path 212 through the downhole tool (e.g., shifting tool 100).

In embodiments, a shifting tool 100 (like shifting tool 100), a system utilizing an shifting tool 100, and/or a method utilizing such a shifting tool 100 and/or system can be advantageously employed in the performance of a wellbore servicing operation. For example, as disclosed herein, the shifting tool 100 allows for a production string (or other tubular) comprising a shifting tool 100 to be placed within a wellbore such that the shifting tool 100 allows fluid communication into the shifting tool and/or production string (e.g., autofilling), thereby maintaining a wellbore pressure integrity, reducing pressure surges on weak formations, reducing costly mud losses, and/or increasing the production string "run-in" speeds. Additionally, the shifting tool 100 can be employed to shift the shifting tool 100 to a second configuration in which no fluid communication into or out of the shifting tool 100 is allowed. The shifting tool 100 can provide the ability to close and/or seal the shifting tool 100, thereby disallowing fluid communication via (e.g., into or out of) the shifting tool 100. As such, the presently disclosed shifting tool 100 can permit an operator to selectively run-in a production string while the production string automatically fills with wellbore fluids, and to close or seal the production string when desired.

Manual filling of the string is time consuming and not very safe, as it puts more people around the rotary table. When filling with brine, there are additional hazards from the fluid. An autofill valve allows the workstring interior to automatically fill while running in the well by having an open exterior port 206. This exterior port 206 must be large enough to avoid plugging. Once the string 170 is at depth the exterior port 206 needs to be (e.g., permanently) closed. This can be accomplished by applying pressure to the interior (e.g., the axial flow bore 115) of the string 170. While applying this pressure, the exterior port 206 can still be open, so the differential pressure to function is only due to the pressure drop from the inside diameter (I) to the outside diameter (E) through the tool ports (e.g., exterior flow port(s) 206). The larger the exterior port(s) 206, the higher the flow rate of fluid 105 pumped into axial flow bore 115 that is required to achieve a sufficient differential to operate the autofill shifting tool 100. Also the higher the flow rate, the greater the pressure spike when the autofill tool or valve closes. This disclosure provides utilization of a fluidic diode(s) 205' to reduce the flow rate required to operate an autofill shifting tool or valve 100 closed. This fluidic diode 205' allows flow to easily go from outside of the shifting tool 100 to the flow bore 200, but the flow from the flow bore 200 to the exterior of the tool E is restricted. The restriction can be accomplished by a combination of the flow sleeve 205 and/or flow port design, flow swirling, and/or flow paths to dead ends, in embodiments.

The use of a fluidic diode 205' in the shifting tool 100 can allow for larger exterior ports 206 to avoid plugging, but will also reduce the flow rate required to close the shifting tool 100 (e.g., an autofill valve shifting tool 100).

It should be understood that the various embodiments previously described can be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

Additional Disclosure

The following are non-limiting, specific embodiments in accordance with the present disclosure:

In a first embodiment a shifting tool comprises: an operating mandrel generally defining an axial flowbore and having an outside surface, wherein the operating mandrel comprises an interior port extending therethrough between the axial flowbore and the outside surface of the operating mandrel, and a recess or groove in the outside surface; a case, wherein the case and the operating mandrel are cylindrical and are connected via a top adapter and a bottom adapter, thus defining a cavity therebetween, and wherein the case comprises an exterior port extending therethrough between the cavity and exterior of the case; a flow sleeve positioned within the cavity, wherein the flow sleeve comprises a fluidic diode designed to facilitate flow in a direction from the exterior port to the interior port along the flow sleeve and restrict flow in the opposite direction from the interior port to the exterior port along the flow sleeve; a shear pin releasably coupling the case to the operating mandrel; a snap ring adjacent the outside surface of the mandrel; and one or more elastomeric seals configured to prevent fluid ingress into the cavity other than via the interior port and the exterior port, wherein, in a first configuration of the shifting tool, a flow path extends from the exterior of the case, via the exterior port, along (e.g., across or through) the flow sleeve, and, via the interior port, to the flow bore of the operating mandrel, and wherein, upon exposure to a pressure differential between the cavity and the flow bore above a threshold pressure differential, the shear pin breaks, such that the shifting tool assumes a second configuration in which the operating mandrel has shifted longitudinally along a central axis of the shifting tool whereby the snap ring extends into the recess or groove in the outside surface of the operating mandrel, thus holding the operating mandrel in the second configuration.

A second embodiment can include the shifting tool of the first embodiment, wherein the operating mandrel is connected with another component, such that the longitudinal shifting of the operating mandrel axial displaces or otherwise actuates the another component.

A third embodiment can include the shifting tool of the second embodiment, wherein the another tool comprises a ball valve.

A fourth embodiment can include the shifting tool of any one of the first to third embodiments, wherein the shifting tool is an autofill tool, wherein, in the first configuration, flow is allowed along the flow path and, in the second configuration, flow is disallowed along the flow path.

A fifth embodiment can include the shifting tool of the any one of the first to fourth embodiments, wherein the flow sleeve comprises a plurality of chambers.

A sixth embodiment can include the shifting tool of the fifth embodiment, wherein the plurality of chambers are offset about a circumference of the shifting tool.

A seventh embodiment can include the shifting tool of any one of the first to sixth embodiments, wherein the flow sleeve comprises a solid cylinder, an outside surface of which is milled with the fluidic diode.

An eighth embodiment can include the shifting tool of the seventh embodiment, wherein the outside surface provides a plurality of fluidic diodes, wherein each fluidic diode provides a flow path from an inlet to an outlet of the fluidic diode.

A ninth embodiment can include the shifting tool of the seventh embodiment, wherein the outside surface provides a single fluidic diode that provides a flow path that wraps around the flow sleeve a plurality of times from an inlet to an outlet of the fluidic diode.

A tenth embodiment can include the shifting tool of any one of the first to ninth embodiments, wherein the flow sleeve comprises a flow piston and a spring, wherein the flow piston is longitudinally situated in the cavity between the top adapter and the spring, wherein, in the first configuration, a pressure port extending from the outside surface of the operating mandrel to the flow bore thereof (e.g., wherein the pressure port extends from a radially inner surface of the operating mandrel to a radially outer surface of the operating mandrel) is covered by the flow piston, and wherein, in an intermediate configuration, upon exposure to a pressure differential between the cavity and the flow bore above another threshold pressure differential, but below the threshold pressure differential, the flow piston shifts longitudinally toward and compresses the spring, such that the interior flow port is covered by the flow piton and the pressure port is unobstructed by the flow piston.

In an eleventh embodiment, a wellbore system comprises: a tubular string disposed within a wellbore; and a shifting tool incorporated within the tubular string and comprising: an operating mandrel generally defining an axial flowbore and having an outside surface, wherein the operating mandrel comprises an interior port extending therethrough between the axial flowbore and the outside surface of the operating mandrel, and a recess or groove in the outside surface; a case, wherein the case and the operating mandrel are cylindrical and are connected via a top adapter and a bottom adapter, thus defining a cavity therebetween, and wherein the case comprises an exterior port extending therethrough between the cavity and exterior of the case; a flow sleeve positioned within the cavity, wherein the flow sleeve comprises a fluidic diode designed to facilitate flow in a direction from the exterior port to the interior port along the flow sleeve and restrict flow in the opposite direction from the interior port to the exterior port along the flow sleeve; a shear pin releasably coupling the case to the operating mandrel; a snap ring adjacent the outside surface of the mandrel; and one or more elastomeric seals configured to prevent fluid ingress into the cavity other than via the interior port and the exterior port, wherein, in a first configuration of the shifting tool, a flow path extends from the exterior of the case, via the exterior port, along (e.g., across or through) the flow sleeve, and, via the interior port, to the flow bore of the operating mandrel, and wherein, upon exposure to a pressure differential between the cavity and the flow bore above a threshold pressure differential, the shear pin breaks, such that the shifting tool assumes a second configuration in which the operating mandrel has shifted longitudinally along a central axis of the shifting tool whereby the snap ring extends into the recess or groove in the outside surface of the operating mandrel, thus holding the operating mandrel in the second configuration.

A twelfth embodiment can include the wellbore system of the eleventh embodiment, wherein the shifting tool is an autofill tool, wherein, in the first configuration, flow is allowed along the flow path and, in the second configuration, flow is disallowed along the flow path.

A thirteenth embodiment can include the wellbore system of the eleventh or twelfth embodiment further comprising: a packer disposed about the tubular string and up-hole relative to the shifting tool; and/or a plug incorporated with the tubular string and down-hole relative to the shifting tool.

In a fourteenth embodiment, a method comprises: positioning a tubular string comprising a shifting tool within a wellbore, wherein the shifting tool comprises: an operating mandrel generally defining an axial flowbore and having an outside surface, wherein the operating mandrel comprises an interior port extending therethrough between the axial flowbore and the outside surface of the operating mandrel, and a recess or groove in the outside surface; a case, wherein the case and the operating mandrel are cylindrical and are connected via a top adapter and a bottom adapter, thus defining a cavity therebetween, and wherein the case comprises an exterior port extending therethrough between the cavity and exterior of the case; a flow sleeve positioned within the cavity, wherein the flow sleeve comprises a fluidic diode designed to facilitate flow in a direction from the exterior port to the interior port along the flow sleeve and restrict flow in the opposite direction from the interior port to the exterior port along the flow sleeve; a shear pin releasably coupling the case to the operating mandrel; a snap ring adjacent the outside surface of the mandrel; and one or more elastomeric seals configured to prevent fluid ingress into the cavity other than via the interior port and the exterior port, wherein, in a first configuration of the shifting tool, a flow path extends from the exterior of the case, via the exterior port, along (e.g., across or through) the flow sleeve, and, via the interior port, to the flow bore of the operating mandrel, and wherein, upon exposure to a pressure differential between the cavity and the flow bore above a threshold pressure differential, the shear pin breaks, such that the shifting tool assumes a second configuration in which the operating mandrel has shifted longitudinally along a central axis of the shifting tool whereby the snap ring extends into the recess or groove in the outside surface of the operating mandrel, thus holding the operating mandrel in the second configuration, wherein the shifting tool is positioned within the wellbore in the first configuration; and exposing the shifting tool to a pressure differential greater than or equal to the first threshold pressure, whereby the shifting tool transitions to the second configuration in response to the pressure differential greater than the first threshold pressure.

A fifteenth embodiment can include the method of the fourteenth embodiment, wherein the shifting of the operating mandrel is utilized to axially displace and/or actuate another tool.

A sixteenth embodiment can include the method of the fifteenth embodiment, wherein the another tool comprises a ball valve.

A seventeenth embodiment can include the method of any one of the fourteenth to sixteenth embodiments, wherein the shifting tool comprises an autofill tool, wherein, in the first configuration, flow is allowed along the flow path and, in the second configuration, flow is disallowed along the flow path.

An eighteenth embodiment can include the method of any one of the fourteenth to seventeenth embodiments, wherein the flow sleeve comprises a plurality of chambers.

A nineteenth embodiment can include the method of the eighteenth embodiment, wherein the chambers are offset about a circumference of the shifting tool.

A twentieth embodiment can include the method of any one of the fourteenth to nineteenth embodiments, wherein the flow sleeve comprises a solid cylinder, an outside surface of which is milled with the fluidic diode.

A twenty first embodiment can include the method of the twentieth embodiment, wherein the outside surface provides a plurality of fluidic diodes, wherein each fluidic diode provides a fluidic diode flow path from an inlet to an outlet of the fluidic diode.

A twenty second embodiment can include the method of the twentieth embodiment, wherein the outside surface provides a single fluidic diode that provides a fluidic diode flow path that wraps around the flow sleeve a plurality of times from an inlet to an outlet of the fluidic diode.

A twenty third embodiment can include the method of any one of the fourteenth to twenty second embodiments, wherein the flow sleeve comprises a flow piston and a spring, wherein the flow piston is longitudinally situated in the cavity between the top adapter and the spring, wherein, in the first configuration, a pressure port extending from the outside surface of the operating mandrel to the flow bore thereof (e.g., wherein the pressure port extends from a radially inner surface of the operating mandrel to a radially outer surface of the operating mandrel) is covered by the flow sleeve, and wherein, in an intermediate configuration, upon exposure to a pressure differential between the cavity and the flow bore above another threshold pressure differential, but below the threshold pressure differential, the flow piston shifts longitudinally toward and compresses the piston, such that the interior flow port is covered by the flow sleeve and the pressure port is unobstructed by the flow sleeve, and wherein the method further comprises: exposing the shifting tool to a pressure differential greater than or equal to the another threshold pressure and less than the threshold pressure, whereby the shifting tool transitions from the first configuration to the intermediate configuration in response to the another pressure differential.

In a twenty fourth embodiment a method comprises actuating a downhole tool by pumping fluid in a direction along a flow path from an interior flow bore of an operating mandrel of the tool, out an interior port of the operating mandrel, across a flow sleeve in a cavity between the operating mandrel and an outer case of the tool, and out an exterior port of the case, wherein the flow sleeve comprises a fluidic diode configured to restrict flow in the direction relative to flow in an opposite direction.

In a twenty fifth embodiment, a downhole tool comprises an operating mandrel having an interior flow bore and an interior port, a flow sleeve comprising a fluidic diode and positioned in a cavity between the operating mandrel and an outer case having an exterior port, wherein, in a first configuration, fluid flow is allowed along a path from the exterior of the case into the cavity via the exterior port, across the flow sleeve, and into the flow bore of the operating mandrel via the interior port, and wherein, in a second configuration, the fluid flow along the flow path is disallowed.

In a twenty sixth embodiment, a downhole tool comprises: a cylindrical tool body having an exterior surface and an interior surface defining a central flow bore having a central axis, a fluid flow path disposed within the tool body, the fluid flow path having a first port disposed in the interior surface and in fluid communication with the flow bore and a second port disposed in the exterior surface and in fluid communication with an exterior of the tool, and a fluidic diode disposed within the fluid flow path, wherein the fluidic diode provides increased resistance to fluid flowing from the first port through the flow path to the second port in comparison to a resistance to fluid flowing from the second port through the flow path to the first port.

A twenty seventh embodiment can include the downhole tool of the twenty sixth embodiment further comprising an actuatable member configured to actuate responsive to the increased resistance to fluid flowing from the first port though the flow path to the second port.

A twenty eighth embodiment can include the downhole tool of the twenty seventh embodiment, wherein the actuatable member comprises a cylindrical sleeve, and wherein the cylindrical sleeve moves along the central axis responsive to an increase in pressure within the central flow bore.

A twenty ninth embodiment can include the downhole tool of the twenty eighth embodiment, wherein the cylindrical sleeve moves along the central axis a distance effective to seal the first port, the second port, or both.

In a thirtieth embodiment, a method of placing the downhole tool of any of the twenty sixth to twenty ninth embodiments or the shifting tool of the first to tenth embodiments into a wellbore penetrating a subterranean formation, comprises: attaching the downhole or shifting tool to a conveyance (e.g., a tubular workstring having a flow bore in fluid communication with the central flow bore of the downhole or shifting tool) and placing the downhole or shifting tool into the wellbore such that an annular space is provided between the exterior surface of the downhole or shifting tool and the wellbore; conveying (e.g., running-in or moving downward) the downhole or shifting tool into the wellbore, wherein during the conveying fluid in the annular space flows from the second port through the flow path to the first port and into the central flow bore of the downhole or shifting tool and conveyance; stopping the conveying when the downhole or shifting tool reaches a desired location in the wellbore; and actuating (e.g., setting) the downhole or shifting tool by flowing fluid downward from the surface through the flow bore of the conveyance and the downhole or shifting tool, wherein during the actuating fluid in the flow bore of the downhole or shifting tool flows from the first port through the flow path to the second port and into the annular space, wherein resistance to fluid flow through the flow path during the conveying is less than resistance to fluid flow through the flow path during the actuating.

In a thirty first embodiment, a method of placing a downhole tool into a wellbore penetrating a subterranean formation, comprises: attaching the downhole tool to a tubular workstring having a flow bore; placing the downhole tool into the wellbore such that an annular space is provided between an exterior surface of the downhole tool and the wellbore; running the downhole tool into the wellbore, wherein during run-in fluid flows from the annular space through the tool and into the flow bore; stopping the run-in when the downhole tool reaches a desired location in the wellbore; and actuating the downhole tool by flowing fluid down the flow bore from the surface and through the tool body into the annular space, wherein resistance to fluid flow through the tool during run-in is less than resistance to fluid flow through the tool during actuating.

A thirty second embodiment can include the method of the thirty first embodiment, wherein an increase in resistance to fluid flow through the tool during actuating is provided by a fluidic diode disposed within a fluid flow path through the downhole tool.

In a thirty third embodiment, a method of placing a downhole tool into a wellbore penetrating a subterranean formation comprises moving a downhole tool in a wellbore, wherein the downhole tool has a fluidic diode disposed therein and during the moving fluid flows through the fluidic diode in a first direction; stopping the moving of the downhole tool in the wellbore; and flowing fluid through the fluidic diode in a second direction that is opposite the first direction.

A thirty fourth embodiment can include the method of the thirty third embodiment, wherein resistance to fluid flow in the second direction is greater than resistance to fluid flow in the first direction.

A thirty fifth embodiment can include the method of the thirty fourth embodiment, wherein the first direction is from an exterior of the tool to an interior of the tool and the second direction is from the interior of the tool to the exterior of the tool.

In a thirty sixth embodiment, a method of servicing a wellbore comprises disposing a fluidic diode within a downhole tool; and flowing fluid from an exterior of the tool through the fluidic diode into an interior of the tool during run-in of the tool into the wellbore.

In a thirty seventh embodiment, a method of servicing a wellbore with a downhole tool comprise flowing fluid from an exterior of the tool through a fluidic diode into an interior of the tool during run-in of the tool into the wellbore.

A thirty eighth embodiment can include the method of the thirty seventh embodiment, further comprising flowing fluid from the interior of the tool through a fluidic diode to the exterior of the tool after stopping the tool at a desired location in the wellbore.

A thirty ninth embodiment can include the method of the thirty eighth embodiment, wherein flowing fluid from the interior of the tool through a fluidic diode to the exterior of the tool actuates the tool.

A fortieth embodiment can include the method of any of the thirty first though thirty ninth embodiments, wherein the downhole tool is a shifting tool according to any one of the first to tenth embodiments, or a downhole tool according to any one of the twenty sixth to twenty ninth embodiments.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 60 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim.

Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A downhole tool comprising:

a cylindrical tool body having an exterior surface and an interior surface defining a central flow bore having a central axis, a fluid flow path disposed within the tool body, the fluid flow path having a first port disposed in the interior surface and in fluid communication with the flow bore and a second port disposed in the exterior surface and in fluid communication with an exterior of the tool, a fluidic diode disposed within the fluid flow path, wherein the fluidic diode provides increased resistance to fluid flowing from the first port through the flow path to the second port in comparison to a resistance to fluid flowing from the second port through the flow path to the first port, and an actuatable member configured to actuate responsive to an increase in pressure within the central flow bore, wherein the actuatable member comprises a cylindrical sleeve, and wherein the cylindrical sleeve moves along the central axis responsive to the increase in pressure within the central flow bore.

2. The downhole tool of claim 1, wherein the cylindrical sleeve moves along the central axis a distance effective to seal the first port, or the second port.

3. The downhole tool of claim 2, wherein the fluidic diode is disposed within an outer surface of the cylindrical sleeve.

4. The downhole tool of claim 3, wherein the fluidic diode comprises a Tesla valve.

5. The downhole tool of claim 1, wherein the downhole tool is an autofill tool, wherein, in a first configuration, flow is allowed along the flow path and, in a second configuration, flow is disallowed along the flow path.

6. The downhole tool of claim 1, wherein the cylindrical sleeve comprises a plurality of chambers.

7. The downhole tool of claim 6, wherein the plurality of chambers are offset about a circumference of the downhole tool.

8. The downhole tool of claim 1, wherein the exterior surface provides a single fluidic diode that provides a flow path that wraps around the cylindrical tool body a plurality of times from an inlet to an outlet of the fluidic diode.

9. A method of placing the downhole tool of claim 1 into a wellbore penetrating a subterranean formation, comprising:

moving the downhole tool in the wellbore, wherein the downhole tool has a the fluidic diode disposed therein, and during the moving, fluid flows through the fluidic diode in a first direction;

stopping the moving of the downhole tool in the wellbore; and flowing fluid through the fluidic diode in a second direction that is opposite the first direction.

10. The method of claim 9 wherein resistance to fluid flow in the second direction is greater than resistance to fluid flow in the first direction.

11. The method of claim 10 wherein the first direction is from an exterior of the tool to an interior of the tool and the second direction is from the interior of the tool to the exterior of the tool.

12. A downhole tool comprising:

an operating mandrel having an interior flow bore and an interior port;

a flow sleeve comprising a fluidic diode, the flow sleeve positioned in a cavity between the operating mandrel and an outer case having an exterior port, wherein, in a first configuration, fluid flow is allowed along a path from the exterior of the case into the cavity via the exterior port, across the flow sleeve, and into the flow bore of the operating mandrel via the interior port; and wherein upon exposure to a pressure differential between the cavity and the flow bore above a threshold pressure, in a second configuration, the fluid flow along the flow path is disallowed; and an actuatable member configured to actuate responsive to an increase in pressure within the central flow bore, wherein the actuatable member comprises a cylindrical sleeve, and wherein the cylindrical sleeve moves along the central axis responsive to the increase in pressure within the central flow bore.

13. The downhole tool of claim 12, wherein the fluidic diode is disposed within an outer surface of the flow sleeve.

14. The downhole tool of claim 13, wherein the fluidic diode comprises a Tesla valve.

15. The downhole tool of claim 12, wherein the flow sleeve comprises a solid cylinder, an outside surface of which is milled with the fluidic diode.

16. The downhole tool of claim 15, wherein the outside surface provides a plurality of fluidic diodes, wherein each fluidic diode provides a flow path from an inlet to an outlet of the fluidic diode.

17. The downhole tool of claim 12, wherein the outside surface provides a single fluidic diode that provides a flow path that wraps around the flow sleeve a plurality of times from an inlet to an outlet of the fluidic diode.

18. The downhole tool of claim 12, wherein the flow sleeve comprises a plurality of chambers.

19. The downhole tool of claim 18, wherein the plurality of chambers are offset about a circumference of the downhole tool.

20. A method of placing a downhole tool into a wellbore penetrating a subterranean formation, wherein the downhole tool comprises: a cylindrical tool body having an exterior surface and an interior surface defining a central flow bore having a central axis, a fluid flow path disposed within the tool body, the fluid flow path having a first port disposed in the interior surface and in fluid communication with the flow bore and a second port disposed in the exterior surface and in fluid communication with an exterior of the tool, and a fluidic diode disposed within the fluid flow path, wherein the fluidic diode provides increased resistance to fluid flowing from the first port through the flow path to the second port in comparison to a resistance to fluid flowing from the second port through the flow path to the first port, the method comprising:

attaching the downhole tool to a conveyance and placing the downhole tool into the wellbore such that an annular space is provided between the exterior surface of the downhole tool and the wellbore;

conveying the downhole tool into the wellbore, wherein during the conveying fluid in the annular space flows from the second port through the flow path to the first port and into the central flow bore of the downhole tool and conveyance;

stopping the conveying when the downhole tool reaches a desired location in the wellbore; and actuating the downhole tool by flowing fluid downward from the surface through the flow bore of the conveyance and the downhole tool, wherein during the actuating fluid in the flow bore of the downhole tool flows from the first port through the flow path to the second port and into the annular space, wherein resistance to fluid flow through the flow path during the conveying is less than resistance to fluid flow through the flow path during the actuating.

21. A method of placing a downhole tool into a wellbore penetrating a subterranean formation, wherein the downhole tool comprises: a cylindrical tool body having an exterior surface and an interior surface defining a central flow bore having a central axis, a fluid flow path disposed within the tool body, the fluid flow path having a first port disposed in the interior surface and in fluid communication with the flow bore and a second port disposed in the exterior surface and in fluid communication with an exterior of the tool, and a fluidic diode disposed within the fluid flow path, wherein the fluidic diode provides increased resistance to fluid flowing from the first port through the flow path to the second port in comparison to a resistance to fluid flowing from the second port through the flow path to the first port, the method comprising:

attaching the downhole tool to a tubular workstring having a flow bore;

placing the downhole tool into the wellbore such that an annular space is provided between an exterior surface of the downhole tool and the wellbore;

running the downhole tool into the wellbore, wherein during run-in fluid flows from the annular space through the tool and into the flow bore;

stopping the run-in when the downhole tool reaches a desired location in the wellbore; and actuating the downhole tool by flowing fluid down the flow bore from the surface and through the tool body into the annular space, wherein resistance to fluid flow through the tool during run-in is less than resistance to fluid flow through the tool during actuating.

22. The method of claim 21, wherein an increase in the resistance to fluid flow through the tool during actuating is provided by a-the fluidic diode disposed within a the fluid flow path through the downhole tool.

* * * * *